US012557879B2

(12) United States Patent
Adami et al.

(10) Patent No.: US 12,557,879 B2
(45) **Date of Patent: *Feb. 24, 2026**

(54) UPPER FOR ARTICLE OF FOOTWEAR

(71) Applicant: Nike, Inc., Beaverton, OR (US)

(72) Inventors: Giovanni Adami, Montebelluna TV (IT); Jeremy L. Connell, Hillsboro, OR (US); Timothy J. Smith, Portland, OR (US); Thomas Marchesini, Verona (IT)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/479,616

(22) Filed: Oct. 2, 2023

(65) Prior Publication Data

US 2024/0023675 A1 Jan. 25, 2024

Related U.S. Application Data

(63) Continuation of application No. 17/513,145, filed on Oct. 28, 2021, now Pat. No. 11,839,262.

(60) Provisional application No. 63/107,499, filed on Oct. 30, 2020.

(51) Int. Cl.
*A43B 23/07* (2006.01)

(52) U.S. Cl.
CPC ..... *A43B 23/07* (2013.01)

(58) Field of Classification Search
CPC ... A43B 23/07; A43B 23/026; A43B 23/0245; A43B 23/0255; A43B 5/02; A43B 5/025
USPC ..... 36/55
See application file for complete search history.

(56) References Cited

U.S. PATENT DOCUMENTS

| | | | | |
|---|---|---|---|---|
| 5,713,141 | A | 2/1998 | Mitchell et al. | |
| 5,952,065 | A | 9/1999 | Mitchell et al. | |
| 6,523,282 | B1 * | 2/2003 | Johnston | A43B 5/02 36/133 |
| 6,582,786 | B1 | 6/2003 | Bonk et al. | |
| 11,484,090 | B2 * | 11/2022 | Chen | A43B 23/0235 |
| 2003/0159312 | A1 * | 8/2003 | Farys | A43B 5/08 36/51 |
| 2005/0282454 | A1 * | 12/2005 | Meschter | B44B 3/007 36/83 |
| 2009/0100712 | A1 | 4/2009 | Baker et al. | |

(Continued)

FOREIGN PATENT DOCUMENTS

EP 2494879 A1 9/2012

*Primary Examiner* — Timothy K Trieu
(74) *Attorney, Agent, or Firm* — Bookoff McAndrews PLLC

(57) ABSTRACT

An upper for an article of footwear includes a carcass layer including an interior liner defining an interior void of the upper and an exterior liner joined to the interior liner to define a plurality of resilient pads protruding from an exterior surface of the upper. In some examples, the upper includes an outer shell attached to the exterior liner of the carcass layer and including a plurality of openings each configured to receive a respective one of the resilient pads therethrough. Here, each of the resilient pads includes a distal end surface defining a first portion of a ball control surface and the outer shell defines a second portion of the ball control surface. In some implementations, each of the resilient pads includes a compressible material enclosed between the interior liner and the exterior liner. Optionally, each of the resilient pads includes a tensile element disposed therein.

20 Claims, 18 Drawing Sheets

(56) References Cited

U.S. PATENT DOCUMENTS

| | | | | |
|---|---|---|---|---|
| 2010/0180469 | A1 | 7/2010 | Baucom et al. | |
| 2012/0324764 | A1* | 12/2012 | Velez-Cruz | A43B 19/00 36/137 |
| 2014/0237858 | A1* | 8/2014 | Adami | A43B 13/141 36/107 |
| 2016/0095389 | A1* | 4/2016 | Minami | A43B 23/0245 36/45 |
| 2017/0035147 | A1* | 2/2017 | Farris | A43B 23/027 |
| 2018/0213886 | A1 | 8/2018 | Connell et al. | |
| 2020/0008529 | A1 | 1/2020 | Luedecke et al. | |
| 2020/0154816 | A1 | 5/2020 | Gaba | |
| 2021/0186158 | A1* | 6/2021 | Capone | B29D 35/146 |
| 2021/0368941 | A1 | 12/2021 | Chen et al. | |

* cited by examiner

UPPER FOR ARTICLE OF FOOTWEAR

CROSS REFERENCE TO RELATED APPLICATIONS

This application is a continuation of U.S. application Ser. No. 17/513,145, filed Oct. 28, 2021, which claims priority under 35 U.S.C. § 119 (e) to U.S. Provisional Patent Application No. 63/107,499, filed Oct. 30, 2020, each of which is incorporated by reference herein in its entirety.

FIELD

The present disclosure relates generally to articles of footwear, and more particularly, to uppers for articles of footwear.

BACKGROUND

This section provides background information related to the present disclosure, which is not necessarily prior art.

Articles of footwear conventionally include an upper and a sole structure. A bottom portion of the upper, proximate to a bottom surface of the foot, attaches to the sole structure. Sole structures generally include a layered arrangement extending between an outsole providing abrasion-resistance and traction with a ground surface and a midsole disposed between the outsole and the upper for providing cushioning for the foot.

The upper may be formed from any suitable material(s) to receive, secure, and support a foot on the sole structure. In conventional articles of footwear, the upper is formed of one or more panels of the materials, which are stitched together to enclose an interior void. Here, different parts of the upper may be formed of different materials to provide desired characteristics. For instance, one or more of the panels may be formed of a breathable material to improve ventilation and comfort, while other panels are formed of more durable materials to provide strength and durability.

The upper may cooperate with laces, straps, or other fasteners to adjust the fit of the upper around the foot. Accordingly, provisions must be made within the panels forming the upper to accommodate routing of the fasteners along the upper. For example, the panels of the upper may be provided with one or more eyelets or guides for routing the laces along the upper. Additionally, to improve fit and maximize comfort, the panels must be conformed to the contours of a foot, and are typically provided with one or more features for facilitating ventilation.

BRIEF DESCRIPTION OF DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
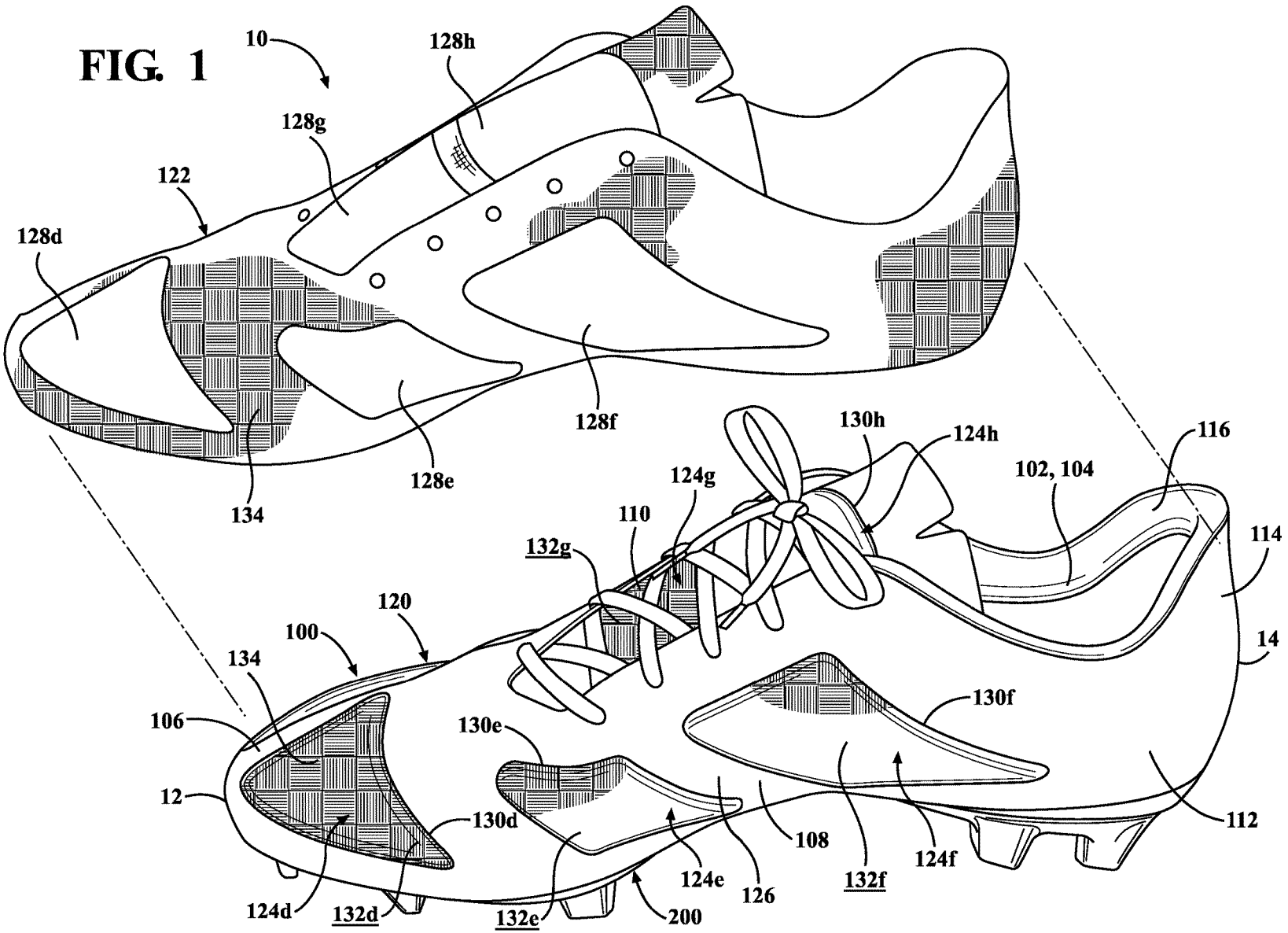
FIG. 1 is an exploded perspective view of an article of footwear having an upper in accordance with the principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

Some aspects of the disclosure include an upper for an article of footwear. The upper includes a carcass layer including an interior liner defining an interior void of the upper and an exterior liner joined to the interior liner to define a plurality of resilient pads protruding from an exterior surface of the upper. Aspects of the disclosure may include one or more of the following optional features.

In some examples, the upper includes an outer shell attached to the exterior liner of the carcass layer and including a plurality of openings each configured to receive a respective one of the resilient pads therethrough. Here, each of the resilient pads includes a distal end surface defining a first portion of a ball control surface and the outer shell defines a second portion of the ball control surface.

In some implementations, each of the resilient pads includes a compressible material enclosed between the interior liner and the exterior liner. In some examples, the compressible material includes a compressible fluid. Optionally, each of the resilient pads includes a tensile element disposed therein.

In some configurations, the plurality of resilient pads includes one or more resilient pads in a toe portion of the upper, one or more resilient pads in a ball portion of the upper, and one or more resilient pads in a mid-foot region of the upper. Optionally, the plurality of resilient pads includes at least one lateral pad disposed on a lateral side of the upper, at least one medial pad disposed on a medial side of the upper, and at least one throat pad disposed on a throat portion of the upper.

In some examples, each of the interior liner and the exterior liner includes a polymeric film material. In some configurations, the interior liner includes a first material and the exterior liner includes a second material that is different than the first material.

Another aspect of the disclosure relates to upper for an article of footwear. Here, the upper includes a carcass layer including an interior liner defining an interior surface of the upper and an exterior liner defining an exterior surface of the upper. The exterior liner is joined to the interior liner along a web area to form a plurality of resilient pads on the exterior surface of the upper.

In some examples, the upper includes an outer shell attached to the exterior liner of the carcass layer and including a plurality of openings each configured to receive a respective one of the resilient pads therethrough. Here, each of the resilient pads may include a distal end surface defining a first portion of a ball control surface and the outer shell defines a second portion of the ball control surface.

In some examples, each of the resilient pads includes a compressible material enclosed between the interior liner and the exterior liner. Optionally, the compressible material includes a compressible fluid. In some configurations, each of the resilient pads includes a tensile element disposed therein.

In some implementations, the plurality of resilient pads includes one or more resilient pads in a toe portion of the upper, one or more resilient pads in a ball portion of the upper, and one or more resilient pads in a mid-foot region of the upper. Optionally, the plurality of resilient pads includes at least one lateral pad disposed on a lateral side of the upper, at least one medial pad disposed on a medial side of the upper, and at least one toe pad disposed on a toe portion of the upper.

In some examples, each of the interior liner and the exterior liner includes a polymeric film material. In some configurations, the interior liner includes a first material and the exterior liner includes a second material that is different than the first material.

The details of one or more implementations of the disclosure are set forth in the accompanying drawings and the description below. Other aspects, features, and advantages will be apparent from the description, the drawings, and the claims.

Figure 2A:
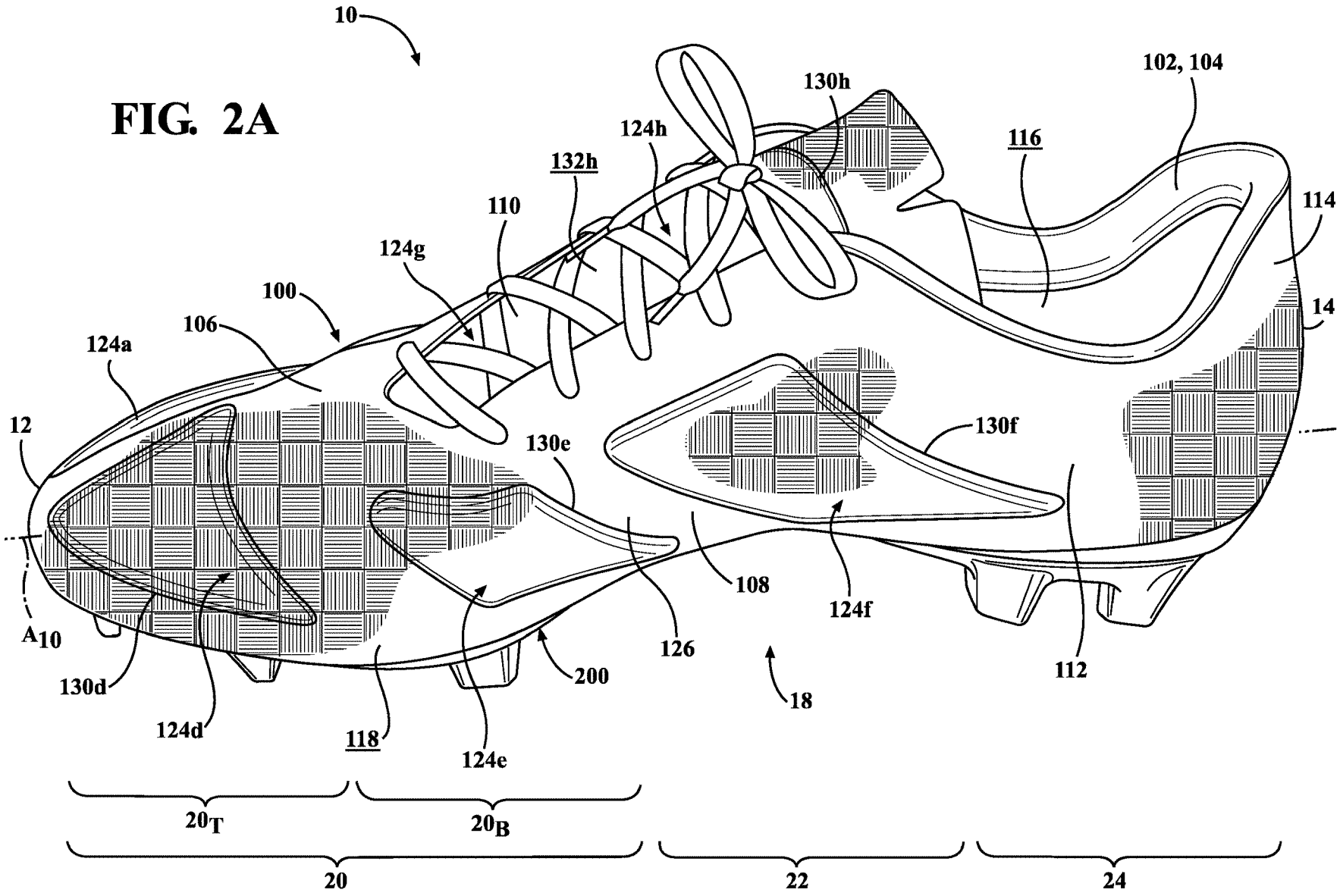
FIG. 2A is a medial side perspective view of the article of footwear of FIG. 1.
Figure 2B:
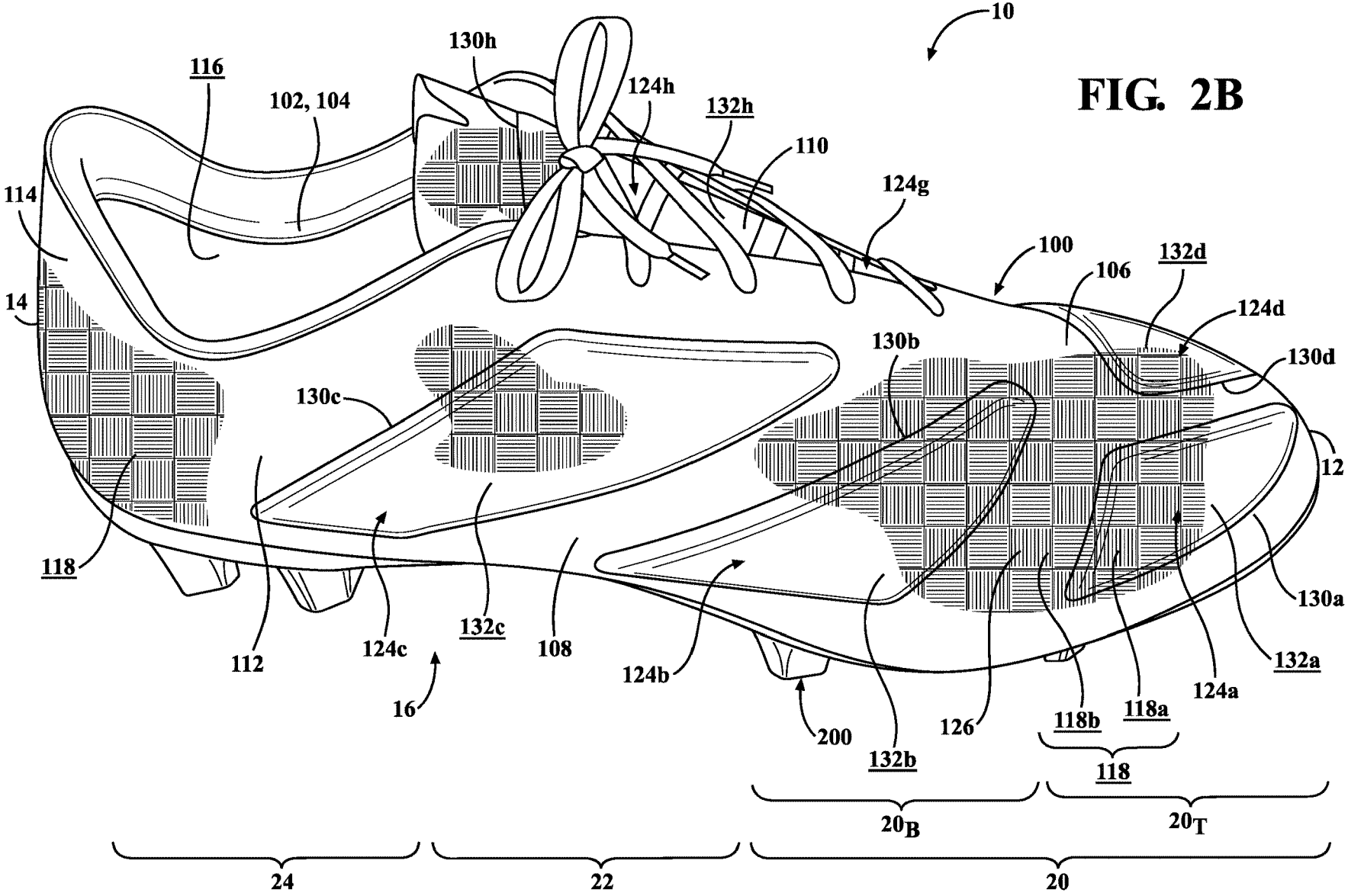
FIG. 2B is a lateral side perspective view of the article of footwear of FIG. 1.
Figure 3:
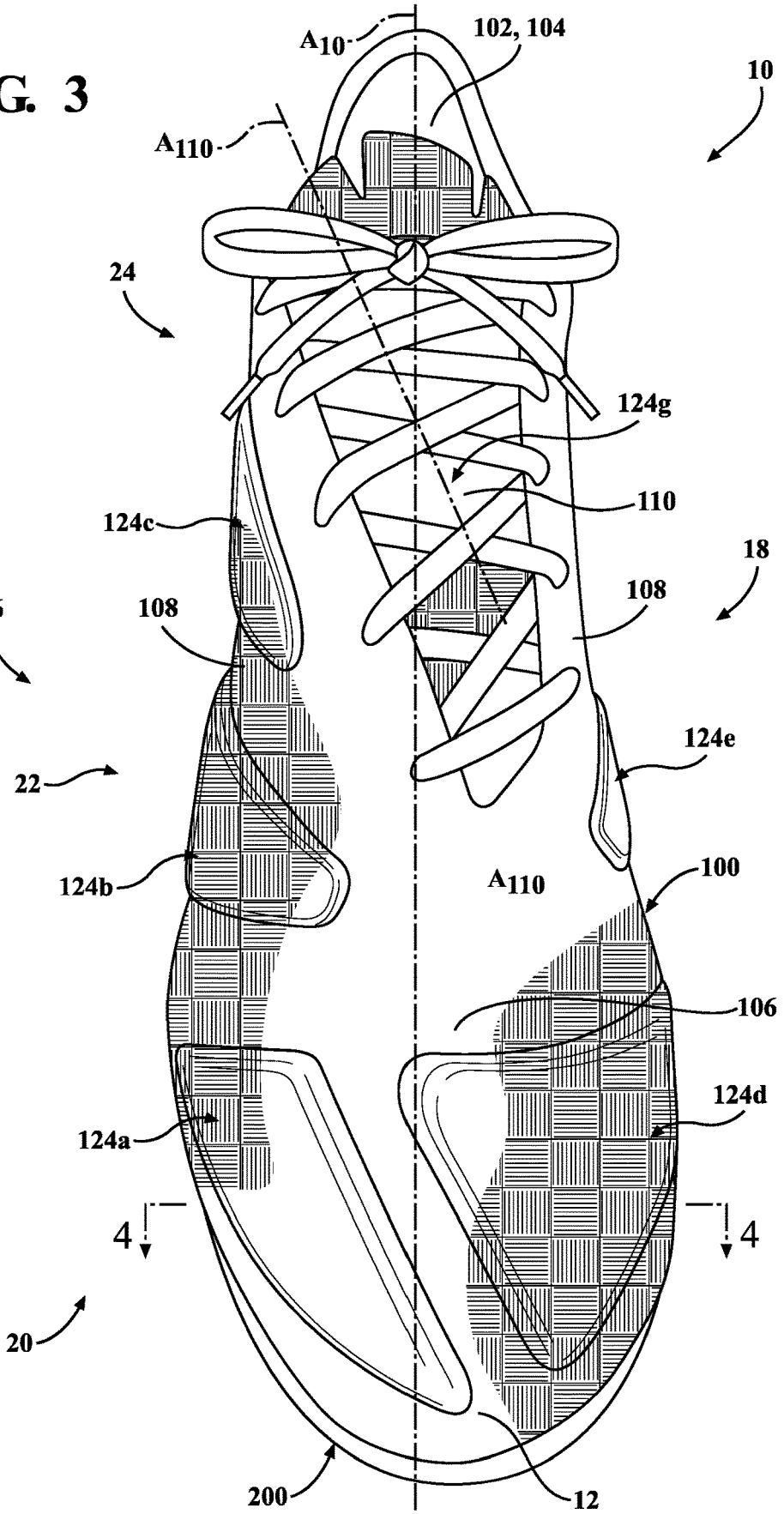
FIG. 3 is a front perspective view of the article of footwear of FIG. 1.

Referring to FIGS. 1-3, an example of an article of footwear 10 is provided. In some implementations, the article of footwear 10 includes an upper 100 and a sole structure 200 attached to the upper 100. The article of footwear 10, and components thereof, may be described as including an anterior end 12 associated with a forward-most point of the footwear 10, and a posterior end 14 corresponding to a rearward-most point of the footwear 10. A longitudinal axis $A_{10}$ of the footwear 10 extends along a length of the footwear 10 from the anterior end 12 to the posterior end 14, and generally divides the footwear 10 into a lateral side 16 and a medial side 18. Accordingly, the lateral side 16 and the medial side 18 respectively correspond with opposite sides of the footwear 10 and extend from the anterior end 12 to the posterior end 14.

The article of footwear 10 may be divided into one or more regions along the longitudinal axis $A_{10}$. The regions may include a forefoot region 20, a mid-foot region 22, and a heel region 24. The forefoot region 20 may correspond with toes and joints connecting metatarsal bones with phalanx bones of a foot. The mid-foot region 22 may correspond with an arch area of the foot, and the heel region 24 may correspond with rear regions of the foot, including a calcaneus bone.

The upper 100 forms an enclosure having a plurality of components that cooperate to define an interior void 102 and an ankle opening 104, which cooperate to receive and secure a foot for support on the sole structure 200. For example, the forefoot region 20 of the upper 100 includes a toe cap 106 disposed at the anterior end 12 and configured to cover the toes of the foot. The toe cap 106 extends over the forefoot region 20 from the lateral side 16 to the medial side 18. In the mid-foot region 22, the upper includes 100 a pair of quarter panels 108 extending from the toe cap 106 on opposite sides of the interior void 102. Accordingly, a first quarter panel 108 extends along the lateral side 16 in the mid-foot region 22 and a second quarter panel 108 extends along the medial side 18 in the mid-foot region 22.

A throat 110 extends across the top of the upper 100 and defines an instep region extending between the quarter panels 108, from a posterior end of the toe cap 106 to an anterior end of the ankle opening 104. In the illustrated example, the throat 110 is formed as an independent component (i.e., a tongue) that is moveable relative to the quarter panels 108. However, in other examples, the throat 110 may be integrally formed with the quarter panels 108, such that the upper 100 extends continuously over the instep of the foot. The throat 110 may include a fastening element, such as laces or straps, for adjusting a fit of the upper 100 around the foot. As best shown in FIG. 3, a longitudinal axis $A_{110}$ of the throat 110 is oriented at an oblique angle relative to the longitudinal axis $A_{10}$ of the article of footwear. Accordingly, a portion of the throat 110 is offset from the center of the upper 100. Additionally or alternatively, a width of the throat 110 may taper along the direction of the longitudinal axis $A_{110}$ from a posterior end to an anterior end of the throat 110. In the illustrated example, an anterior portion of the throat 110 is offset towards the medial side 18 of the upper 100. The offset and/or tapered arrangement of the throat 110 maximizes a ball control area formed on the lateral side 16 of the upper 100.

The heel region 24 of the upper 100 includes a pair of heel side panels 112 extending through the heel region 24 along the lateral and medial sides 16, 18 of the ankle opening 104. Each of the heel side panels 112 extends from a posterior end of a respective one of the quarter panels 108. A heel counter 114 wraps around the posterior end 14 of the footwear 10 and connects the heel side panels 112 to each other. Uppermost edges of the throat 110, the heel side panels 112, and the heel counter 114 cooperate to form a collar, which defines the ankle opening 104 of the interior void 102.

The foregoing components and/or portions of the upper 100 cooperate to form an interior surface 116 defining the interior void 102 of the upper 100, and an exterior surface 118 formed on an opposite side from the interior surface 116. As described in greater detail below, the upper 100 may be formed from one or more materials that are joined together to form the aforementioned components or portions of the upper 100. The example upper 100 may be formed from a combination of one or more substantially inelastic or non-stretchable materials and one or more substantially elastic or stretchable materials disposed in different regions of the upper 100 to facilitate movement of the article of footwear 10 between the tightened state and the loosened state. The one or more elastic materials may include any combination of one or more elastic fabrics such as, without limitation, spandex, elastane, rubber, or neoprene. The one or more inelastic materials may include any combination of one or more of thermoplastic polyurethanes, nylon, leather, vinyl, or another material/fabric that does not impart properties of elasticity.

With reference to FIG. 1, the illustrated example of the upper 100 includes an inner carcass layer 120 and an optional outer shell 122. The inner carcass layer 120 forms the interior surface 116 of the upper 100, while the carcass layer 120 and the outer shell 122, when included, cooperate to define the exterior surface 118 of the upper 100. The exterior surface 118 of the upper 100 is configured as a ball control surface 118 and includes a plurality of resilient pads 124*a*-124*h* arranged along each of the lateral side 16, the medial side 18, and the throat 110. The resilient pads 124*a*-124*h* are separated from each other by a web area 126. As described in greater detail below, the resilient pads 124*a*-124*h* are formed by the carcass layer 120, while the web area 126 includes the carcass layer 120 and the shell 122. The resilient pads 124*a*-124*h* of the carcass layer 120 are exposed through corresponding openings 128*a*-128*h* formed through the shell 122 such that when the shell 122 is included in the upper 100, the shell 122 surrounds each of the resilient pads 124*a*-124*h*.

Each of the resilient pads 124*a*-124*h* includes a peripheral wall 130*a*-130*h* defining a peripheral profile of the resilient pad 124*a*-124*h*, and a distal end surface 132*a*-132*h* that protrudes from the web area 126 of the upper 100. Here, the distal end surfaces 132*a*-132*h* of each of the resilient pads 124*a*-124*h* cooperate to define a primary ball control surface 118*a* and the web area 126 provides a secondary ball control surface 118*b* that is recessed from the primary ball control surface 118*a*. Thus, in use, a ball may initially contact the primary ball control surface 118*a* collectively defined by one or more of the distal end surfaces 132*a*-132*h*. As the one or more resilient pads 124*a*-124*h* compress, the ball may engage the secondary ball control surface 118*b* formed by the web area 126.

The exterior surface 118, collectively defined by the primary ball control surface 118*a* and the secondary ball control surface 118*b*, may include one or more gripping features for maximizing engagement with a ball during use. For example, the exterior surface 118 may be formed of or include materials having a relatively high coefficient of friction. Additionally or alternatively, the exterior surface 118 may include physical gripping features 134. In the illustrated example, the exterior surface 118 is embossed to form a plurality of ribs 134 arranged in a checkered pattern. For example, the gripping features 134 include a first plurality of squares defined by ribs 134 extending in a first direction (e.g., vertical) and a second plurality of squares defined by ribs 134 extending in a second direction (e.g. horizontal) transverse to the first direction. The embossed pattern of ribs 134 is formed continuously over the entire exterior surface 118. Accordingly, as discussed in greater detail below, the web area 126 and the resilient pads 124 may be embossed with a continuous pattern of the gripping features 134.

With continued reference to FIGS. 1-3, one example of the upper 100 includes a first plurality of the resilient pads 124*a*-124*c* arranged along the lateral side 16 of the upper 100, and a second plurality of the resilient pads 124*d*-124*f* arranged along the medial side 18 of the upper 100. The first plurality of resilient pads 124*a*-124*c* includes a lateral toe pad 124*a* disposed on the lateral side 16 of the toe cap 106 in the toe portion $\mathbf{20}_T$, a lateral forefoot pad 124*b* disposed on the lateral quarter panel 108 in the ball portion $\mathbf{20}_B$ of the forefoot region 20, and a lateral mid-foot pad 124*c* disposed on the lateral quarter panel 108 in the mid-foot region 22. Similarly, the second plurality of resilient pads 124*d*-124*f* includes a medial toe pad 124*d* disposed on the medial side of the toe cap 106 in the toe portion $\mathbf{20}_T$, a medial forefoot pad 124*e* disposed on the medial quarter panel 108 in the ball portion $\mathbf{20}_B$ of the forefoot region 20, and a medial mid-foot pad 124*f* disposed on the medial quarter panel 108 in the mid-foot region 22. Optionally, the upper 100 may include one or more throat pads 124*g*, 124*h* formed on the tongue or throat 110 of the upper 100.

Figure 5:
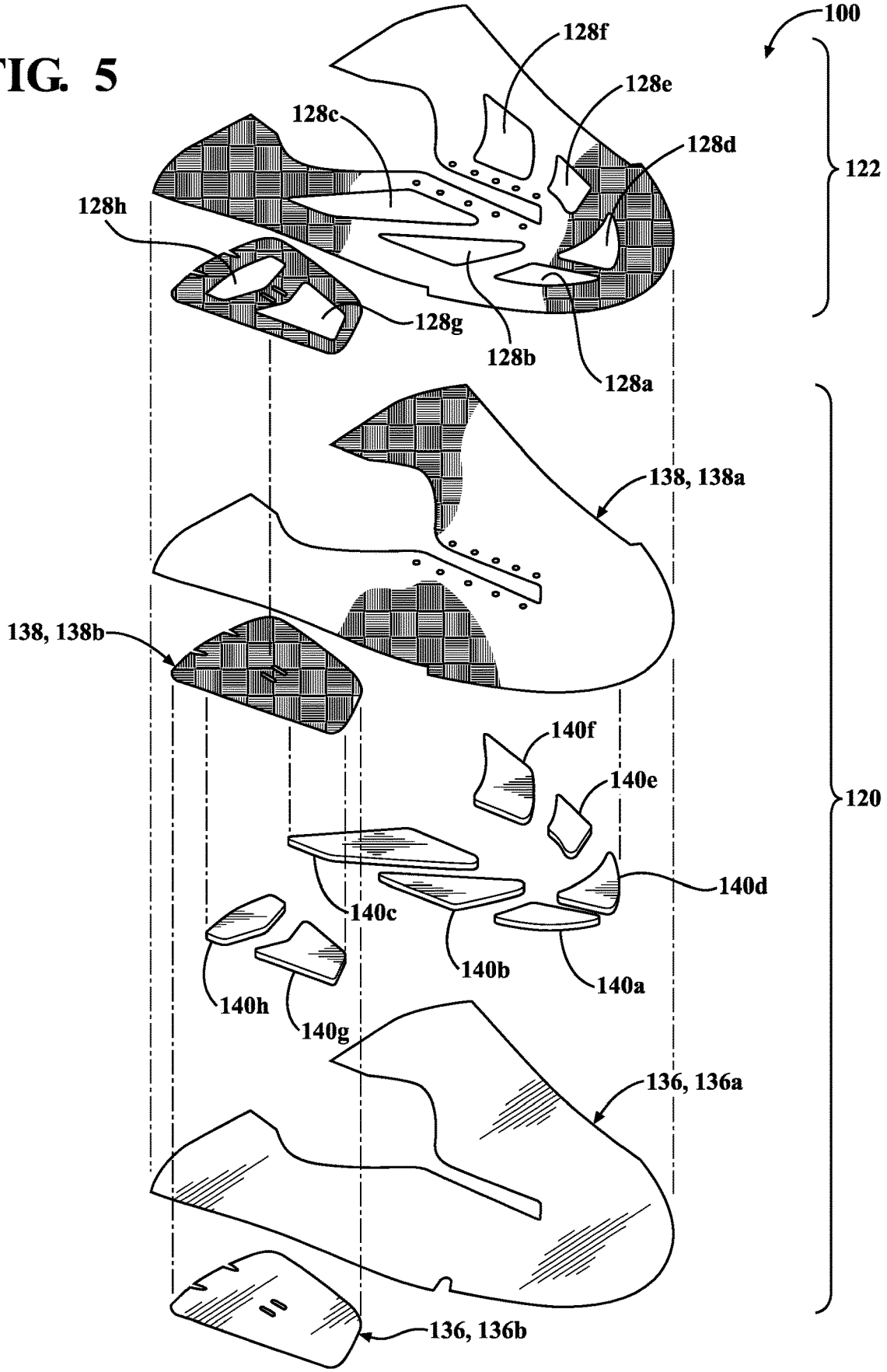
FIG. 5 is an exploded view of the upper of the article of footwear of FIG. 1.

With reference to FIG. 5, the example of the upper 100 of the article of footwear 10 is shown in an exploded state. As shown, the upper 100 includes a plurality of components that are configured to be joined together to form the resilient pads 124*a*-124*h* and the web area 126. More specifically, the upper 100 includes the carcass layer 120 defining a plurality of the pads 124*a*-124*h* and the web area 126, and the optional shell 122 configured to be attached to the web area 126. As shown, the carcass layer 120 and the shell 122 are configured to form the entire upper 100. Thus, the components 106, 108, 110, 112, 114 of the upper 100 may be integrally formed of the carcass layer 120 and the optional shell 122.

With continued reference to FIG. 5, the carcass layer 120 of the upper 100 is formed as a bladder and includes a pair of liners 136, 138 joined together at discrete locations to define the web area 126 and the resilient pads 124*a*-124*h*. Particularly, the carcass layer 120 may include an interior liner 136 that defines the interior surface 116 of the upper 100 and an exterior liner 138 that defines the outer, exterior surface 118 of the upper 100. In the illustrated example, each of the interior liner 136 and the exterior liner 138 may be separated into a boot portion 136*a*, 138*a* configured to form the toe cap 106, quarter panels 108, heel side panels 112, and the heel counter 114. The liners 136, 138 may also include a tongue portion 136*b*, 138*b* forming the throat 110 of the upper 100. However, as provided above, the throat 110 may be integrally formed with the upper 100 such that each of the barrier layers 136, 138 is provided as a unitary body (i.e., a single piece forms the entire layer).

Figure 4A:
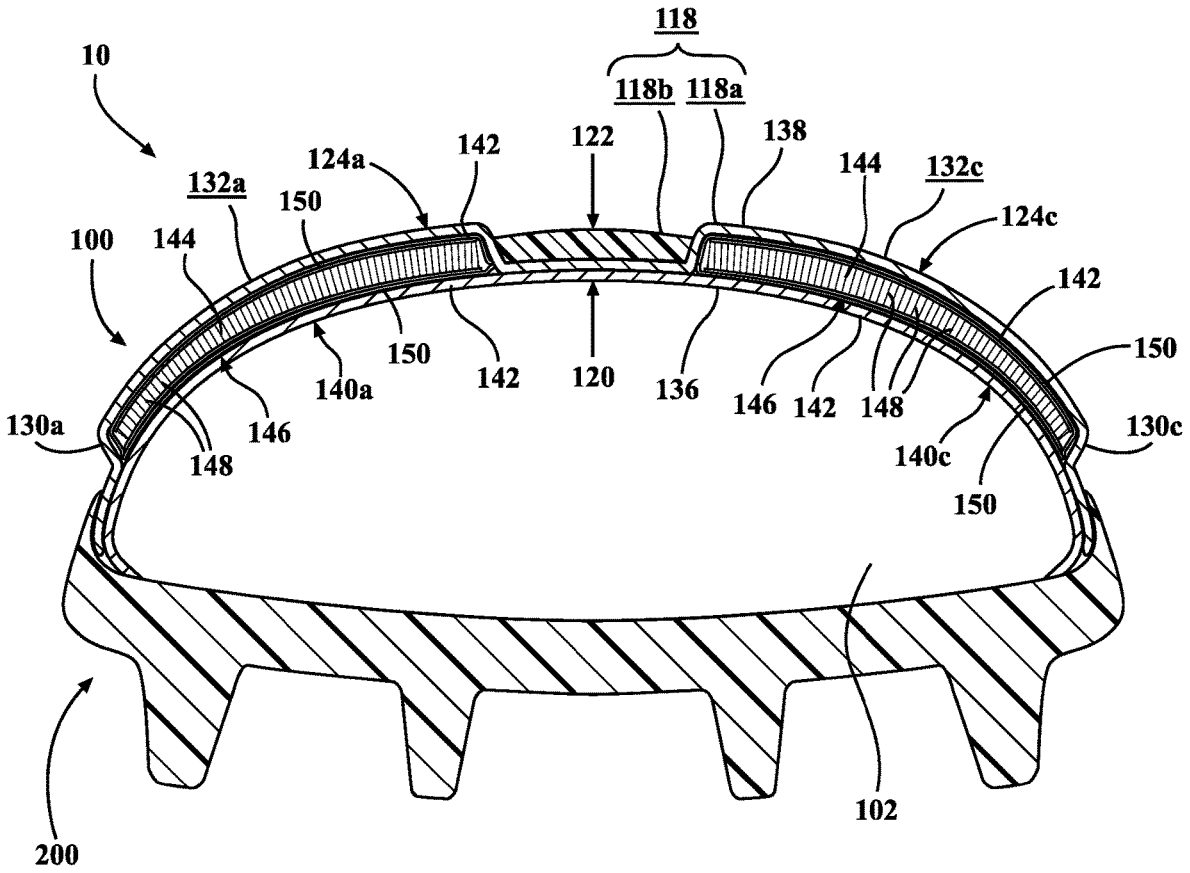
FIGS. 4A-4C are cross-sectional views of examples of the article of footwear of FIG. 1, taken along Line 4-4 of FIG. 3.
Figure 4B:
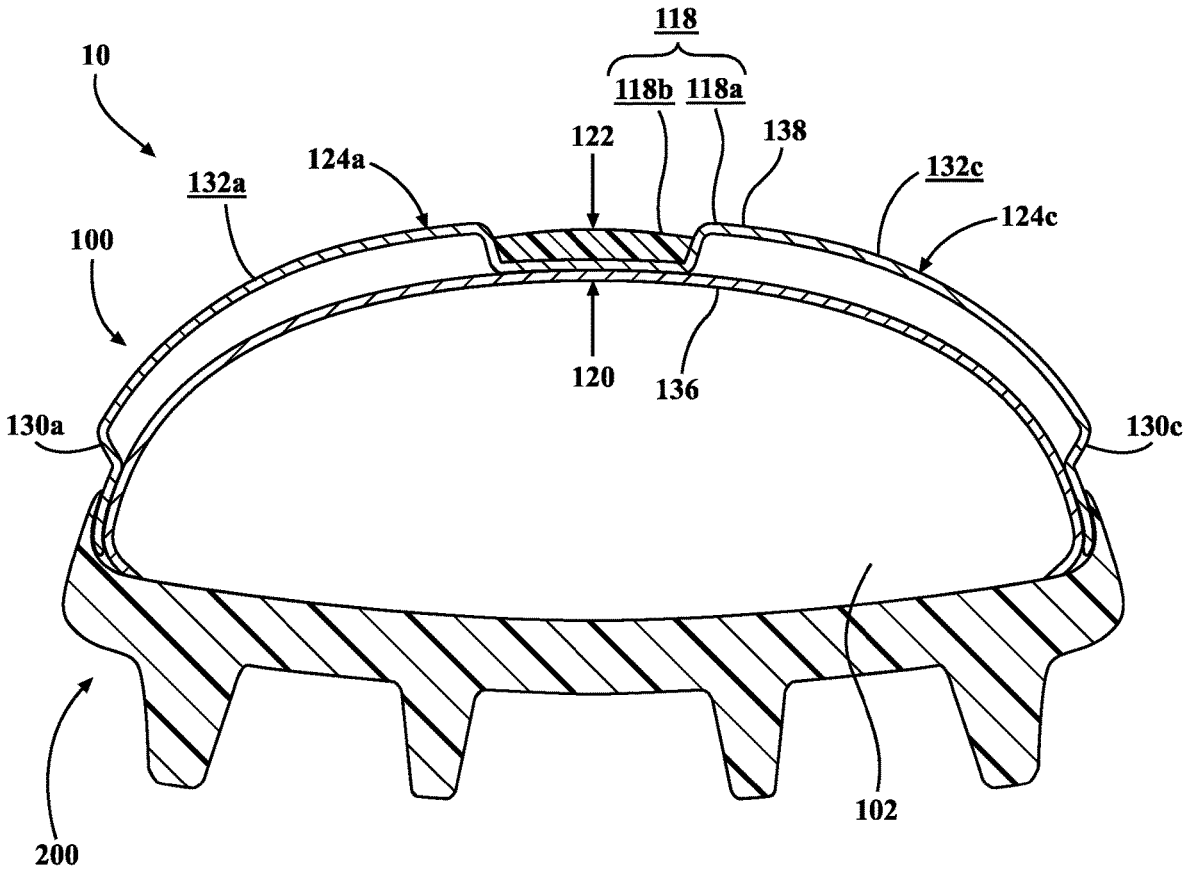
Figure 4C:
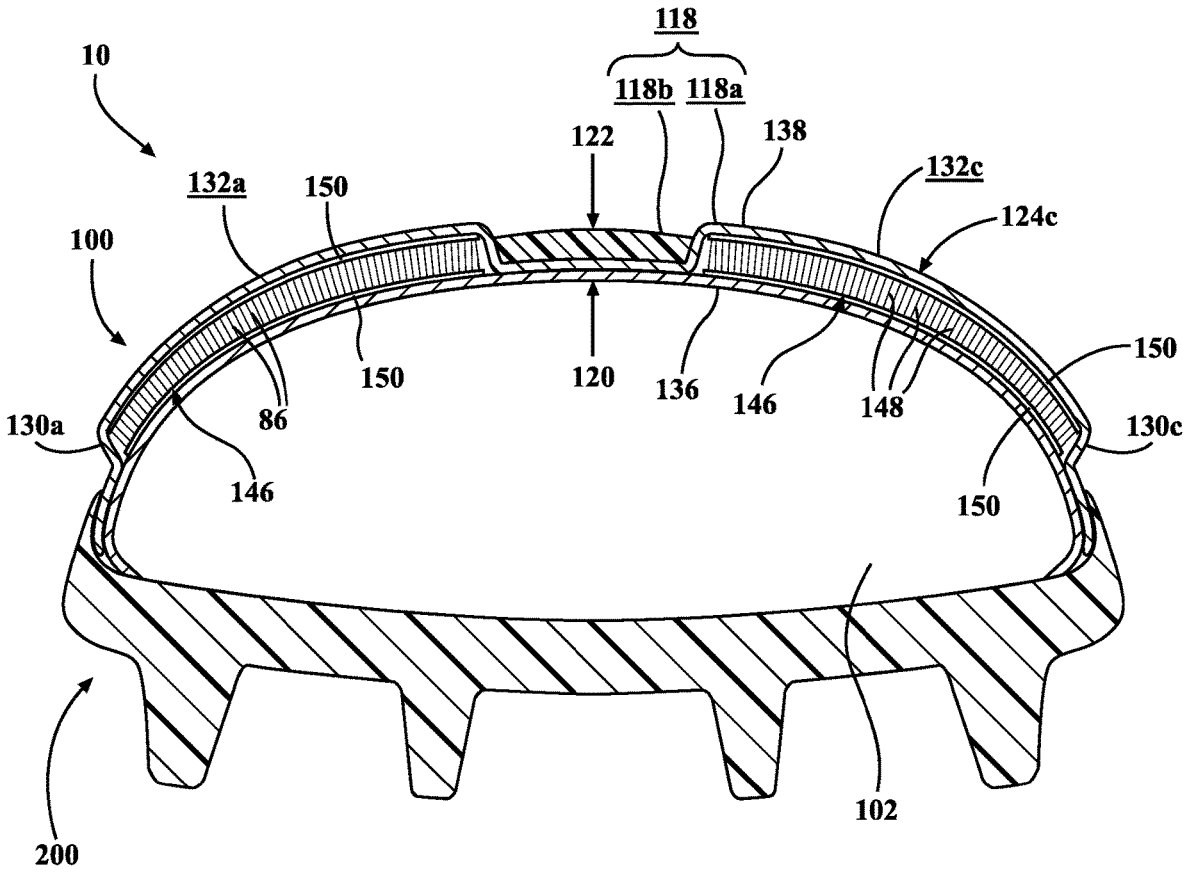

With continued reference to FIGS. 4A-5, the carcass layer 120 includes a plurality of cushioning elements 140*a*-140*h* configured to be disposed within the interior voids of each of the resilient pads 124*a*-124*h*. The cushioning elements 140*a*-140*h* may include one or more compressible materials, including compressible solids and/or fluids. Thus, while FIGS. 4A and 5 show the cushioning elements 140*a*-140*h* as physical components having a shape corresponding to each of the resilient pads 124*a*-124*h*, it will be understood that the interior voids of the resilient pads 124*a*-124*h* may be directly filled with a compressible fluid (FIG. 4B) sealed within the resilient pad 124*a*-124*h* by the web area 126, as discussed in greater detail below. In other aspects, the resilient pads 124*a*-124*h* can alternatively include other compressible media, such as pellets, beads, ground recycled material, and the like (e.g., foamed beads and/or rubber beads). Optionally, the interior void of one or more of the resilient pads 124*a*-124*h* of the carcass layer 120 may directly receive a tensile element 146 (FIG. 4C) therein for restraining the barrier layers 136, 138 when the interior voids are pressurized.

Referring to FIG. 4A, one or more of cushioning elements 140*a*-140*h* may be formed as fluid-filled chambers 140*a*-140*h* each having a pair of barrier layers 142 joined to each other at discrete locations to define a shape of the respective cushioning element 140*a*-140*h*. Alternatively, the cushioning elements 140*a*-140*h* can be produced from any suitable combination of one or more barrier layers. While FIG. 4A illustrates the cushioning elements 140*a*, 140*c* of the toe pads 124*a*, 124*c*, the cushioning elements 140*b*, 140*d*-140*f* of the other pads 124*b*, 124*d*-124*f* of the upper 100 may be similarly constructed.

As used herein, the term "barrier layer" (e.g., barrier layers 142) encompasses both monolayer and multilayer films. In some embodiments, one or both of the barrier layers 142 are each produced (e.g., thermoformed or blow molded) from a monolayer film (a single layer). In other embodiments, one or both of the barrier layers 142 are each produced (e.g., thermoformed or blow molded) from a multilayer film (multiple sublayers). In either aspect, each layer or sublayer can have a film thickness ranging from about 0.2 micrometers to about be about 1 millimeter. In further embodiments, the film thickness for each layer or sublayer can range from about 0.5 micrometers to about 500 micrometers. In yet further embodiments, the film thickness for each layer or sublayer can range from about 1 micrometer to about 100 micrometers.

One or both of the barrier layers 142 can independently be transparent, translucent, and/or opaque. As used herein, the term "transparent" for a barrier layer and/or a fluid-filled chamber means that light passes through the barrier layer in substantially straight lines and a viewer can see through the barrier layer. In comparison, for an opaque barrier layer, light does not pass through the barrier layer and one cannot see clearly through the barrier layer at all. A translucent barrier layer falls between a transparent barrier layer and an opaque barrier layer, in that light passes through a translucent layer but some of the light is scattered so that a viewer cannot see clearly through the layer.

The barrier layers 142 can each be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4,4'-diisocyanate (DDDI), 4,4'-dibenzyl diisocyanate (DBDI), 4-chloro-1,3-phenylene diisocyanate, and combinations thereof. In some embodiments, the copolymer chains are substantially free of aromatic groups.

In particular aspects, the polyurethane polymer chains are produced from diisocynates including HMDI, TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials, as well as with the TPU copolymers described herein and optionally including combinations of polyimides and crystalline polymers, are also suitable.

The barrier layers 142 may include two or more sublayers (multilayer film) such as shown in Mitchell et al., U.S. Pat. No. 5,713,141 and Mitchell et al., U.S. Pat. No. 5,952,065, the disclosures of which are incorporated by reference in their entireties. In embodiments where the barrier layers 142 include two or more sublayers, examples of suitable multilayer films include microlayer films, such as those disclosed in Bonk et al., U.S. Pat. No. 6,582,786, which is incorporated by reference in its entirety. In further embodiments, the barrier layers 142 may each independently include alternating sublayers of one or more TPU copolymer materials and one or more EVOH copolymer materials, where the total number of sublayers in each of the barrier layers 142 includes at least four (4) sublayers, at least ten (10) sublayers, at least twenty (20) sublayers, at least forty (40) sublayers, and/or at least sixty (60) sublayers.

The cushioning elements 140*a*-140*h* can be produced from the barrier layers 142 using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an aspect, the barrier layers 142 can be produced by co-extrusion followed by vacuum thermoforming to form the profile of the cushioning elements 140*a*-140*h*, which can optionally include one or more valves (e.g., one way valves) that allows the cushioning elements 140*a*-140*h* to be filled with the fluid (e.g., gas).

The cushioning elements 140*a*-140*h* desirably have a low gas transmission rate to preserve their retained gas pressure. In some embodiments, the cushioning elements 140*a*-140*h* have a gas transmission rate for nitrogen gas that is at least about ten (10) times lower than a nitrogen gas transmission rate for a butyl rubber layer of substantially the same dimensions. In an aspect, cushioning elements 140*a*-140*h* have a nitrogen gas transmission rate of 15 cubic-centimeter/square-meter·atmosphere·day ($cm^3/m^2 \cdot atm \cdot day$) or less for an average film thickness of 500 micrometers (based on thicknesses of barrier layers 142). In further aspects, the transmission rate is 10 $cm^3/m^2 \cdot atm \cdot day$ or less, 5 $cm^3/m^2 \cdot atm \cdot day$ or less, or 1 $cm^3/m^2 \cdot atm \cdot day$ or less.

In the illustrated example, the interior surfaces of the barrier layers 142 of the cushioning elements 140*a*-140*h* are joined together at discrete locations to form an outer peripheral seam defining shapes of the cushioning elements 140*a*-140*h*. The barrier layers 142 are spaced apart from each other to define respective interior voids 144 of each of the cushioning elements 140*a*-140*h*. Optionally, the interior voids 144 of the cushioning elements 140*a*-140*h* may receive a tensile element 146 therein. Each tensile element 146 may include a series of tensile strands 148 extending between an upper tensile sheet 150 and a lower tensile sheet 150. The upper tensile sheet 150 may be attached to the first barrier layer 142 while the lower tensile sheet 150 may be attached to the second barrier layer 142. In this manner, when the cushioning element 140*a*-140*h* receives a pressurized fluid, the tensile strands 148 of the tensile elements 146 are placed in tension. Because the upper tensile sheet 150 is attached to the first barrier layer 142 and the lower tensile sheet 150 is attached to the second barrier layer 142, the tensile strands 148 retain a desired shape of the respective cushioning element 140*a*-140*h* when the pressurized fluid is injected into the interior void 144.

While FIG. 4A represents an upper 100 where each of the resilient pads 124*a*-124*h* includes an independently formed cushioning element 140*a*-140*h*, in other examples, the resilient pads 124*a*-124*h* may be directly pressurized. In these examples, the liners 136, 138 of the carcass layer 120 function as the barrier layers for enclosing an interior void of the resilient pads 124*a*-124*h*. As provided above, the resilient pads 124*a*-124*h* may be directly filled with a compressible material, as represented by FIG. 4B, or may have the tensile element 146 directly attached to the liners 136, 138, as represented in FIG. 4C. Any one or more of the resilient pads 124*a*-124*h* may include the cushioning elements 140*a*-140*h* (FIG. 4A), be directly filled with the compressible fluid (FIG. 4B), or include the directly attached tensile element (FIG. 4C).

Where the resilient pads 124*a*-124*h* include compressible fluids (e.g., the resilient pads 124*a*-124*h* are filled with air), either in the form of direct pressurization or by including independently formed fluid-filled chambers 140*a*-140*h*, the resilient pads 124*a*-124*h* can be provided in a fluid-filled (e.g., as provided in footwear 10) or in an unfilled state. The resilient pads 124*a*-124*h* can be filled to include any suitable fluid, such as a gas or liquid. In an aspect, the gas can include air, nitrogen ($N_2$), or any other suitable gas. The fluid provided to the resilient pads 124*a*-124*h* can result in the resilient pads 124*a*-124*h* being pressurized. Alternatively, the fluid provided to the resilient pads 124*a*-124*h* can be at atmospheric pressure such that the resilient pads 124*a*-124*h* are not pressurized but, rather, simply contain a volume of fluid at atmospheric pressure.

In the illustrated example, the interior voids of the resilient pads 124*a*-124*h* may include the same or different pressures from each other. For instance, a first pressure within the interior void of one of the resilient pads 124*a*-124*h* may be less than a second pressure within a different one of the resilient pads 124*a*-124*h* when the carcass layer 120 is in an uncompressed (i.e., natural) state. Additionally or alternatively, the resilient pads 124*a*-124*h* may be formed with different thicknesses. The combination of different pressures and/or thicknesses provide zonal performance characteristics along the exterior ball control surface 118. For example, the toe pads 124*a*, 124*d* and/or the forefoot pads 124*b*, 124*e* may have a greater pressure and/or lesser thickness than the mid-foot pads 124*c*, 124*f* to provide a greater energy return while kicking a ball with the toe or forefoot of the foot. Conversely, the mid-foot pads 124*c*, 124*f* may be tuned with a lower pressure and/or greater thickness than the toe pads 124*a*, 124*d* and/or the forefoot pads 124*b*, 124*e* to provide less energy return (i.e., damping) when handling or receiving a passed ball.

Figure 6:
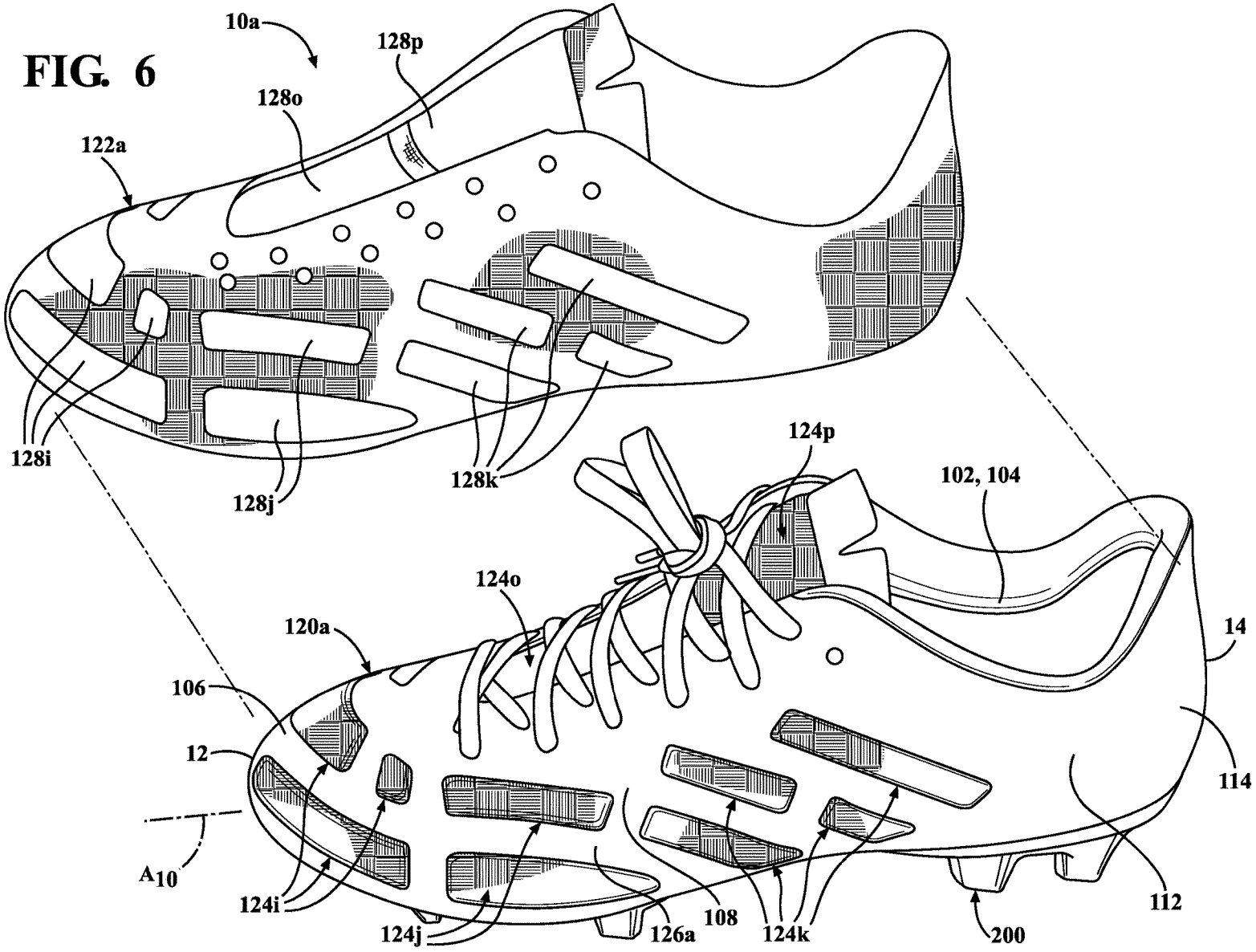
FIG. 6 is an exploded perspective view of an article of footwear having an upper in accordance with the principles of the present disclosure.
Figure 7A:
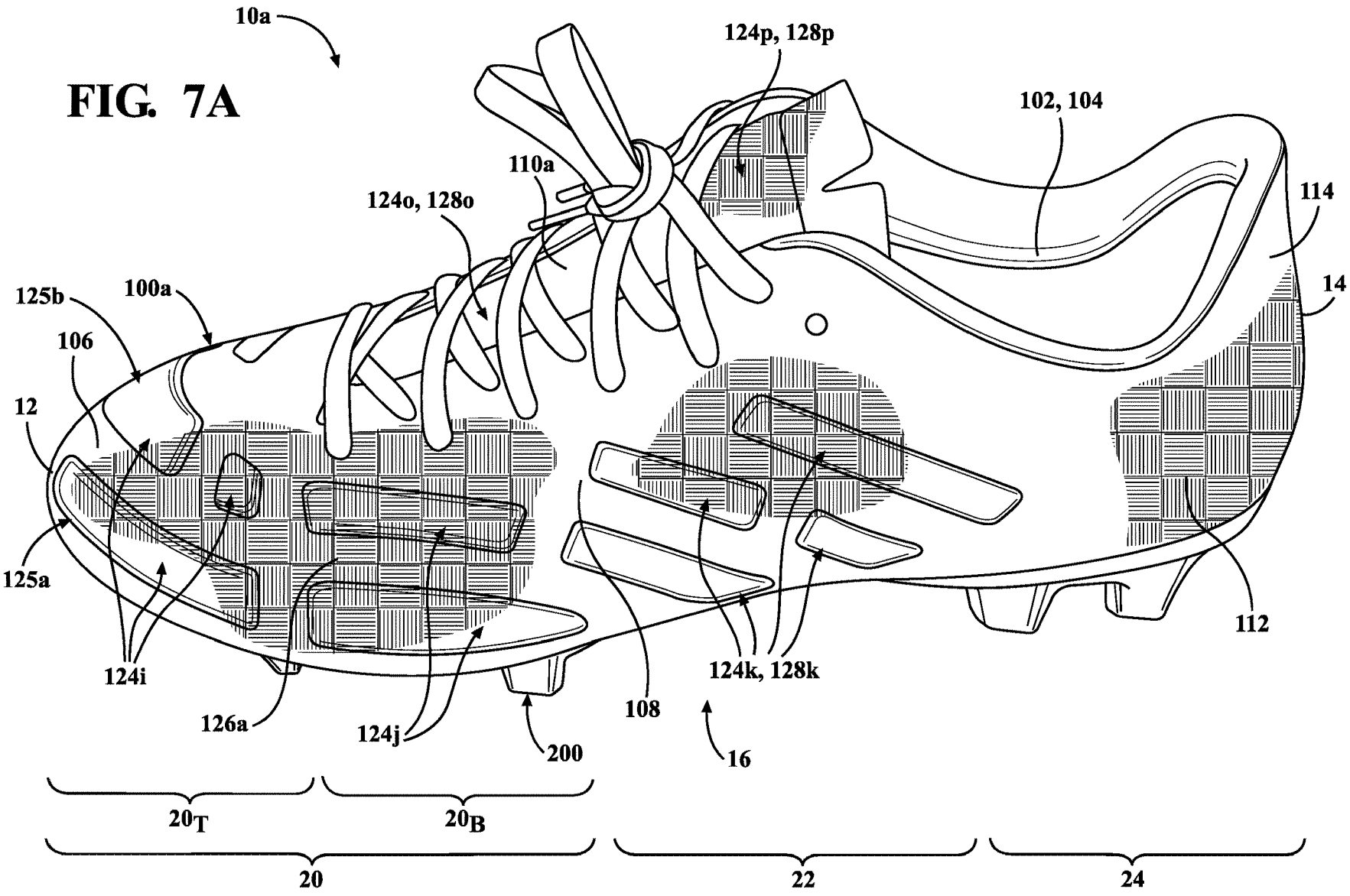
FIG. 7A is a lateral side perspective view of the article of footwear of FIG. 1.
Figure 7B:
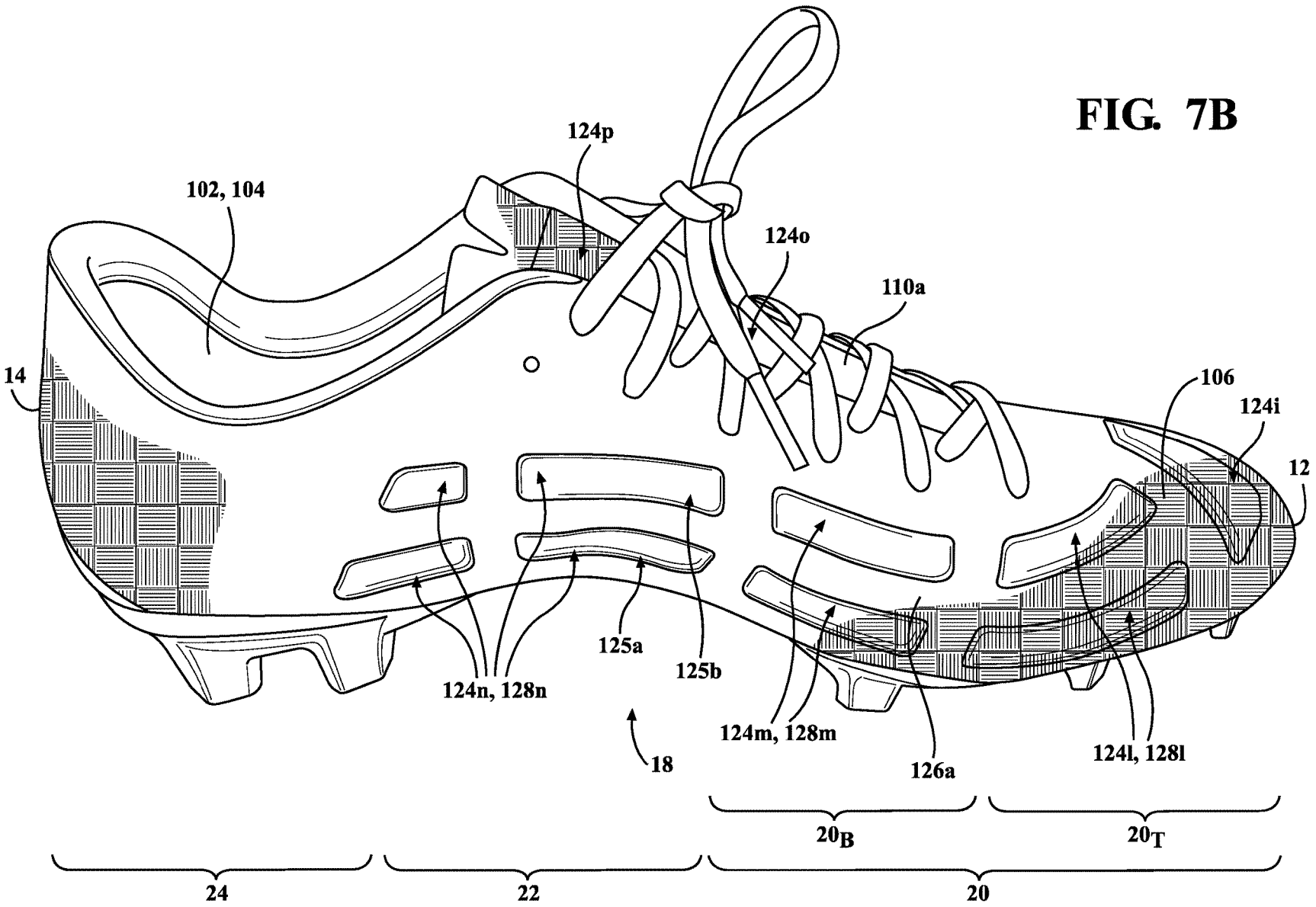
FIG. 7B is a medial side perspective view of the article of footwear of FIG. 1.
Figure 8:
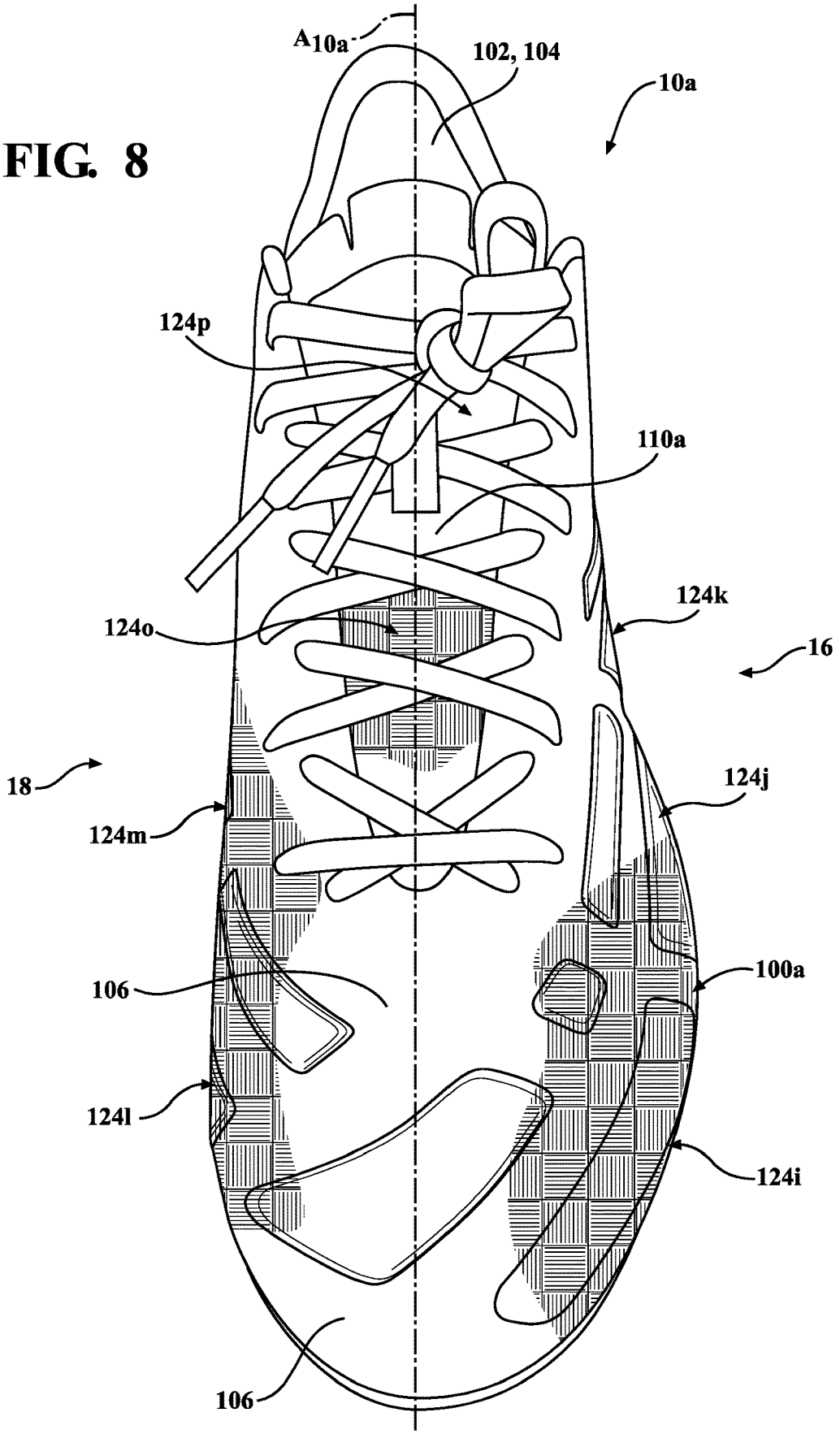
FIG. 8 is a front perspective view of the article of footwear of FIG. 1.

With particular reference to FIGS. 6-8, an article of footwear 10*a* is provided and includes an upper 100*a* and a sole structure 200 attached to the upper 100*a*. In view of the substantial similarity in structure and function of the components associated with the article of footwear 10 with respect to the article of footwear 10*a*, like reference numerals are used hereinafter and in the drawings to identify like components while like reference numerals containing letter extensions are used to identify those components that have been modified.

The upper 100*a* of the article of footwear 10*a* shown in FIGS. 6-8 can be constructed in a substantially similar fashion as upper 100 of the article of footwear 10 discussed previously, and includes an inner carcass layer 120*a* and an optional outer shell 122*a* cooperating to define a plurality of resilient pads 124*i*-124*p*. In the example of the upper 100*a* shown in FIGS. 6-8, the resilient pads 124*i*-124*p* may be formed as one or more groups of the resilient pads 124*i*-124*p* arranged in different regions of the upper 100*a*. Each of the resilient pads 124*i*-124*p* may extend and be exposed through a corresponding opening 128*i*-128*p* formed in the web area 126.

With reference to FIG. 7A, the lateral side 16 of the upper 100*a* includes a first group of pads 124*i* disposed in the toe portion $\mathbf{20}_T$, a second group of pads 124*j* disposed in the ball portion $\mathbf{20}_B$, and a third group of pads 124*k* disposed in the mid-foot region 22. Similarly, the medial side 18 of the upper 100*a* includes a fourth group of pads 124*l* disposed in the toe portion $\mathbf{20}_T$, a fifth group of pads 124*m* disposed in the ball portion $20_B$, and a sixth group of pads 124*n* disposed in the mid-foot region 22. Thus, unlike the upper 100 discussed above, where a single pad 124*a*-124*f* is disposed in each of the ball control zones $20_T$, $20_B$, 22 of the upper 100, each of the ball control zones $20_T$, $20_B$, 22 of the upper 100*a* includes a plurality of the resilient pads 124*i*-124*n* that cooperate to form the primary ball control surface 118*a*. Each of the pads 124*i*-124*n* may be described as including an elongate shape extending along the periphery of the upper 100*a*. Optionally, the upper 100 may include one or more throat pads 124*o*, 124*p* formed on the tongue or throat 110 of the upper 100, similar to the throat pads 124*g*, 124*h* above.

Optionally, the groups of the resilient pads 124*i*-124*n* of the upper 100 may also be arranged to form segmented rows 125*a*, 125*b* of the resilient pads 124*i*-124*n* extending continuously around a periphery of the upper 100. For example, the upper 100*a* may include a first row 125*a* of the resilient pads 124*i*-124*n* extending from the ball portion $20_B$ on the lateral side 16 and around the anterior end 12 to the mid-foot region 22 on the medial side 18. As shown in FIGS. 8A and 8B, the first row 125*a* includes a lateral forefoot pad 124*j*, a lateral toe pad 124*i*, a medial toe pad 124*l*, a medial forefoot pad 124*m*, and a pair of medial mid-foot pads 124*n* arranged in series around the periphery of the upper 100*a*. A second row 125*b* is disposed above the first row 125*a* and is vertically spaced from the first row 125*a* by the web area 126*a*. The second row 125*b* includes a lateral mid-foot pad 124*k*, a lateral forefoot pad 124*j*, a lateral toe pad 124*i*, a medial toe pad 124*l*, a medial forefoot pad 124*m*, and a pair of medial mid-foot pads 124*n* arranged in a second series around the periphery of the upper 100*a*, above the first row 125*a*.

In some examples, corresponding pads 124*i*-124*n* of each row 125*a*, 125*b* may be vertically aligned with each other. For example, the medial mid-foot pads 124*n* of the first row 125*a* are vertically aligned with the medial-mid-foot pads 124*n* of the second row 125*b*. More specifically, ends of the corresponding pads 124*i*-124*n* of the first and second rows 125*a*, 125*b* may be aligned with each other such that the web area 126*a* extends continuously through and intersects the upper and lower rows 125*a*, 125*b*.

Figure 9A:
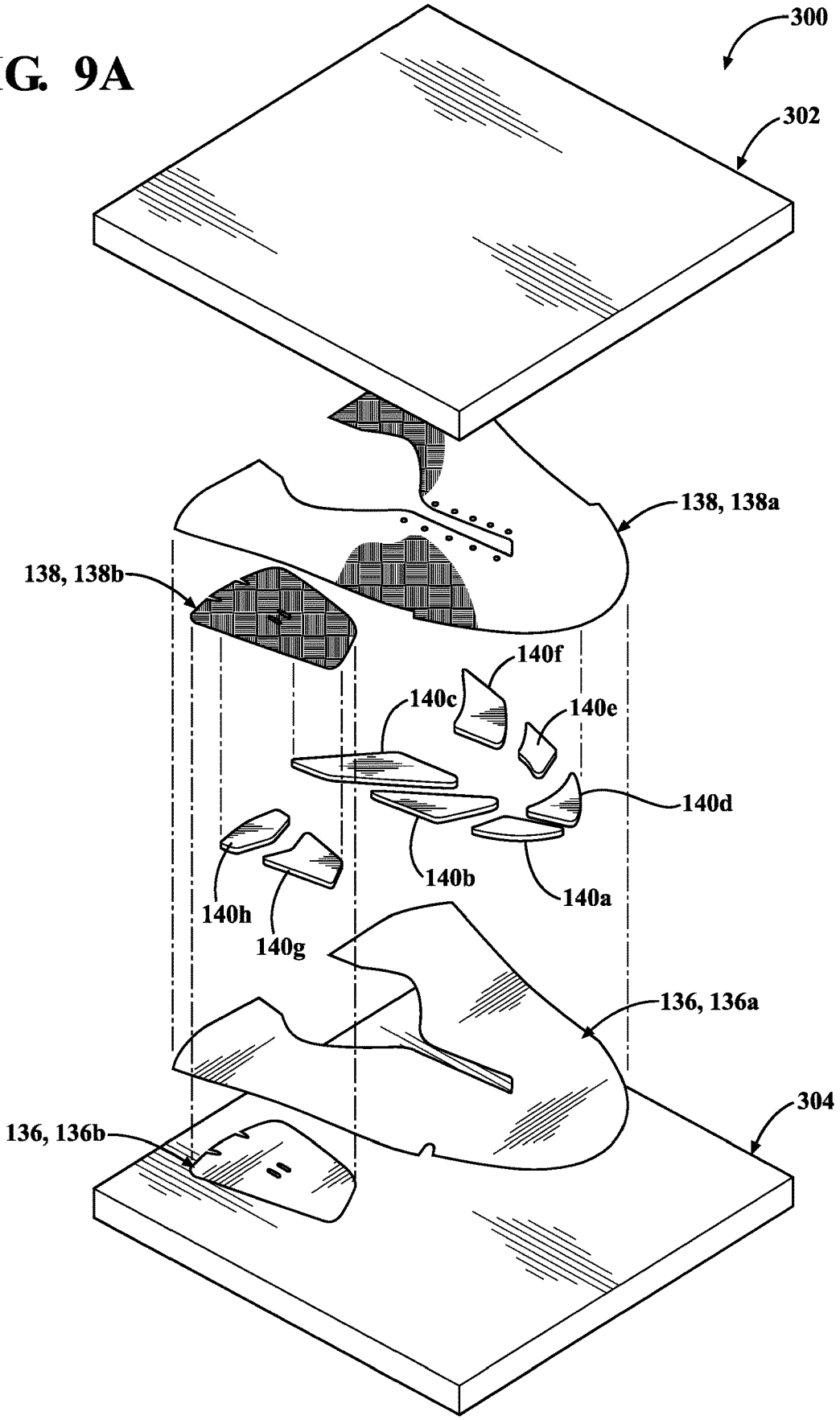
FIGS. 9A-9C show a system and steps of a method for using the system to form the upper of the article of footwear of FIG. 1.
Figure 9B:
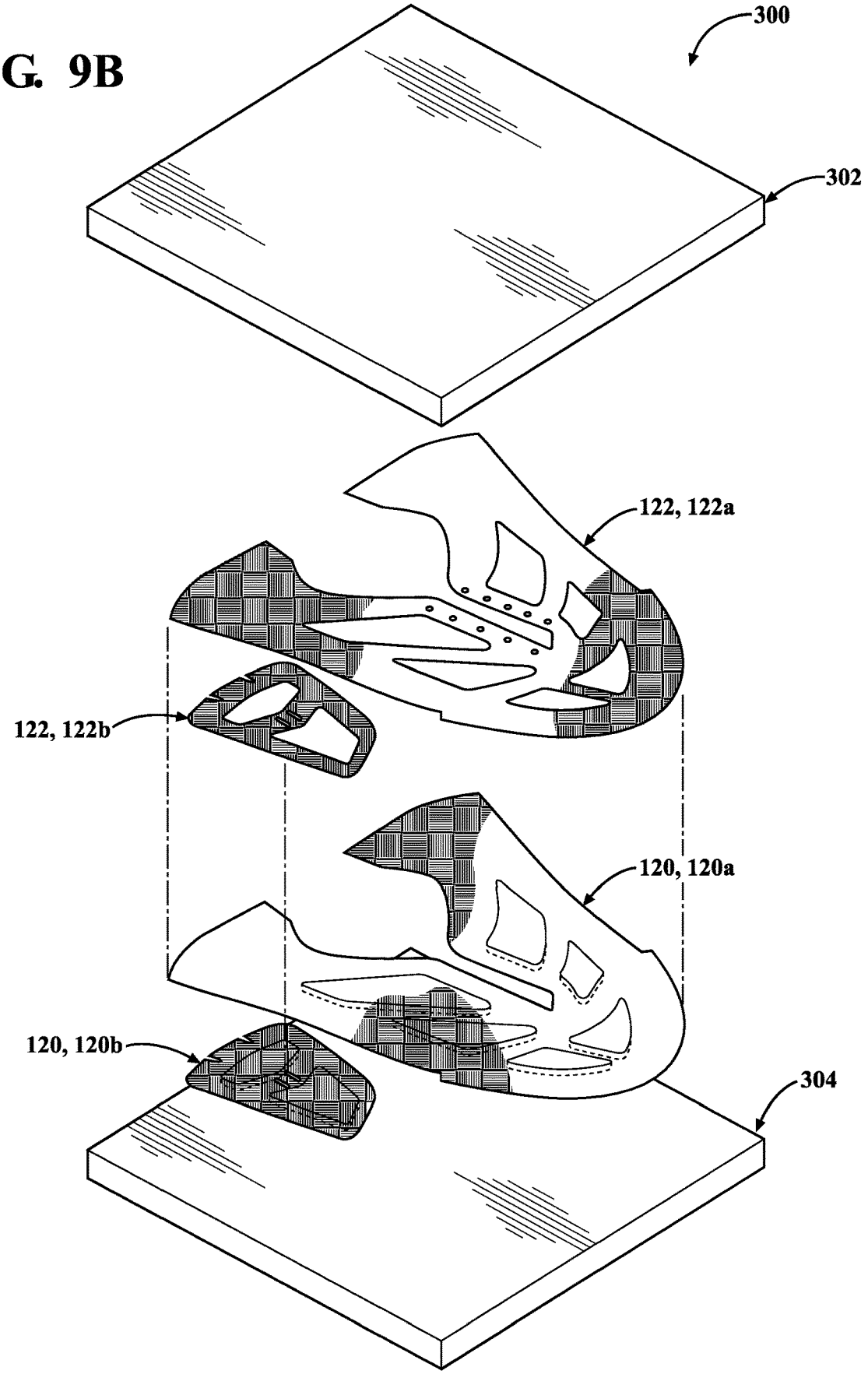
Figure 9C:
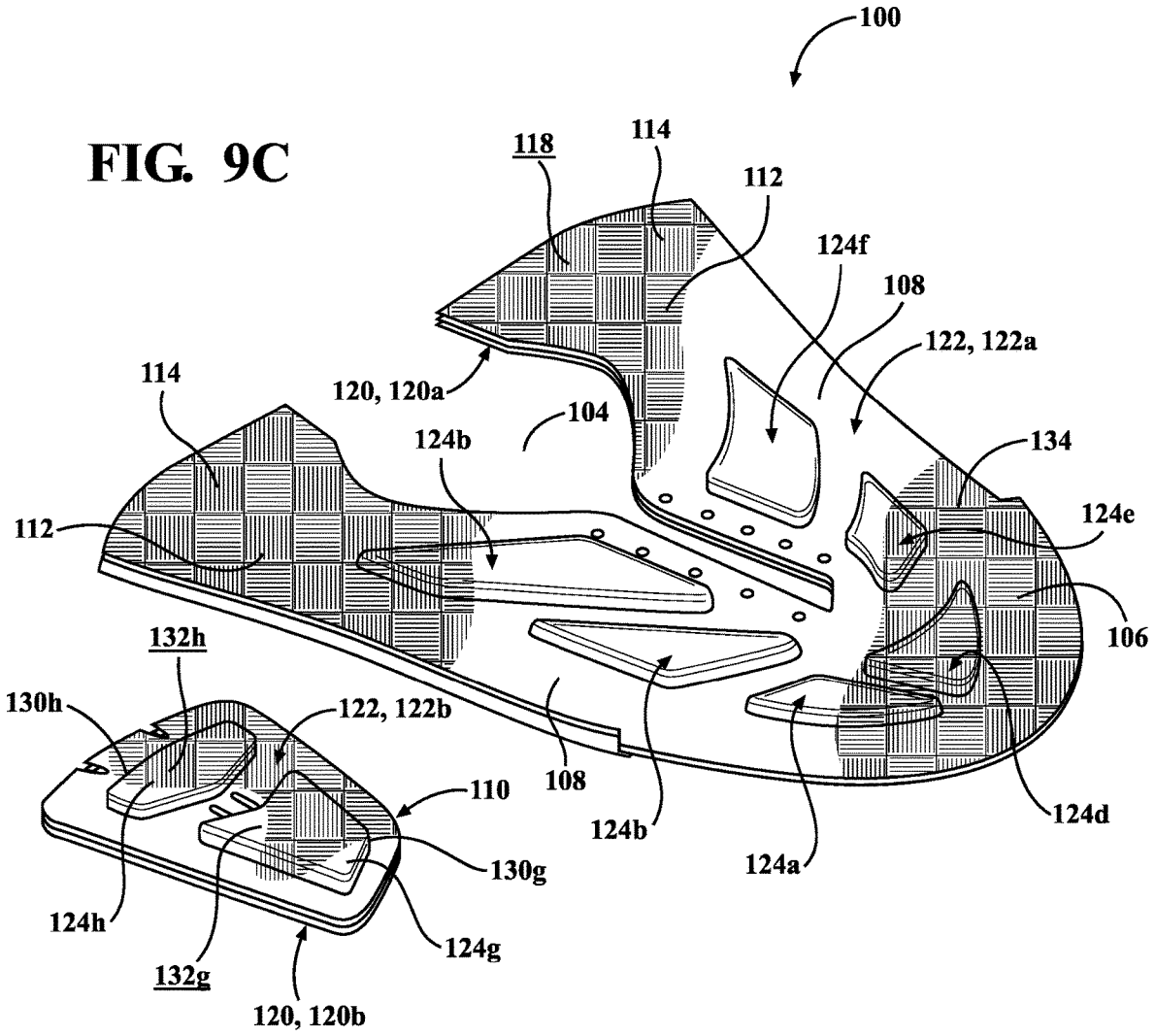

With reference to FIGS. 9A-9C, an example system 300 and method for forming the upper 100 of FIGS. 1-5 is shown. While the system 300 and method are described with respect to the upper 100 of FIGS. 1-5, the same system 300 and method could be used to form the upper 100*a* of FIGS. 6-8B. The system 300 is a press 300 and includes a first mold half 302 and a second mold half 304. As shown, each mold half 302, 304 includes a platen 302, 304 having a substantially planar mold surface. Accordingly, as discussed below, the same system 300 can be easily adapted for manufacturing uppers having any configuration of resilient pads 124 without needing specialized tooling.

In a first step, the components for forming the carcass layer 120 are provided to the press 300. Here, the inner liner 136 and the outer liner 138*a* each includes a first portion 136*a*, 138*a* for forming a boot including the toe cap 106, quarter panels 108, heel side panels 112, and heel counter 114 of the upper 100. Respective second portions 136*b*, 138*b* of the liners 136, 138 are configured to form the throat or tongue 110 of the upper 100. In this example, the upper 100 is formed with a plurality of the cushioning elements 140*a*-140*h*, which are positioned between the liners 136, 138 within the press 300 in areas corresponding to the desired locations of the resilient pads 124*a*-124*h* of the finished upper 100. The interior surfaces of the liners 136, 138 may be provided with a thermo adhesive film or coating configured to join or attach the interior surface of the inner liner 136 to the inner surface of the exterior liner 138. With the components 136, 138, 140*a*-140*h* of the carcass layer 120 arranged in the press 300, the press 300 is moved to the closed position and the components 136, 138, 140*a*-140*h* are subjected to heat and/or pressure to join the liners 136, 138 together with the cushioning elements 140*a*-140*h* disposed therebetween.

At FIG. 6B, the assembled carcass layer 120, including a boot portion 120*a* and tongue portion 120*b*, is attached to the shell 122, which includes a corresponding boot portion 122*a* and tongue portion 122*b*. Here, another layer of the thermo adhesive film or coating may be disposed between the carcass layer 120 and the shell 122, whereby, when the press 300 is closed, the thermo adhesive film or coating is melted to join the carcass layer 120 and the shell 122 together. In some examples, all of the components 120, 136, 138, 140*a*-140*h* of the upper 100 may be simultaneously pressed in a single operation to join the components together with the melted thermo adhesive film or coating. Optionally, one or both of the platens 302, 304 of the press 300 may have a mold surface including the embossing pattern for forming the gripping features 134. Thus, when the shell 122 is joined to the carcass layer 120, the gripping features 134 are formed over the entire ball control surface 118 of the upper 100.

As shown in FIG. 9C, the carcass layer 120 and the shell 122 cooperate to define a blank for forming the entire upper, including the toe cap 106, the quarter panels 108, the heel side panels 112, the heel counter 114, and the throat or tongue 110. Thus, unlike conventional uppers that may include a plurality of independently formed components joined or stitched to define the various components of the upper, the upper 100 of the present disclosure can consist of a unitary piece including the carcass layer 120, the shell 122, and the cushioning elements 140*a*-140*h*.

Referring now to FIGS. 10A-10H, a system 400 and method or process for using the system 400 to form a generic example of a carcass layer 120 according to the principles of the present disclosure is provided. Unlike the examples of the carcass layers 120, 120*a* shown above with respect to the articles of footwear 10, 10*a*, where the resilient pads 124*a*-124*p* include independently formed cushioning elements 140*a*-140*p* disposed therein, the system 400 is configured to directly form resilient pads 124 of a carcass layer 120*b* using the liners 136, 138. In other words, the liners 136, 138 function as barrier layers defining the resilient pads 124 of the carcass layer 120*b*.

The system 400 includes a mold 402 and a vacuum source 404. As shown, the mold 402 includes an opposing pair of platens 406*a*, 406*b* which cooperate with each other to define a mold chamber 408. As shown, a first one of the platens 406*a* includes geometries for forming geometries of the resilient pads 124 in the exterior liner 138 of the carcass layer, while the second platen 406*b* is provided with a planar mold surface 407 corresponding to the flat inner liner 136. However, in other examples, geometries of both of the platens 406*a*, 406*b* may include mold cavities 416 and/or geometries of one of the platens 406*a*, 406*b* may be different from geometries of the other one of the platens 406*a*, 406*b* to impart different characteristics and geometries to the carcass layer 120*b*.

Figure 10A:
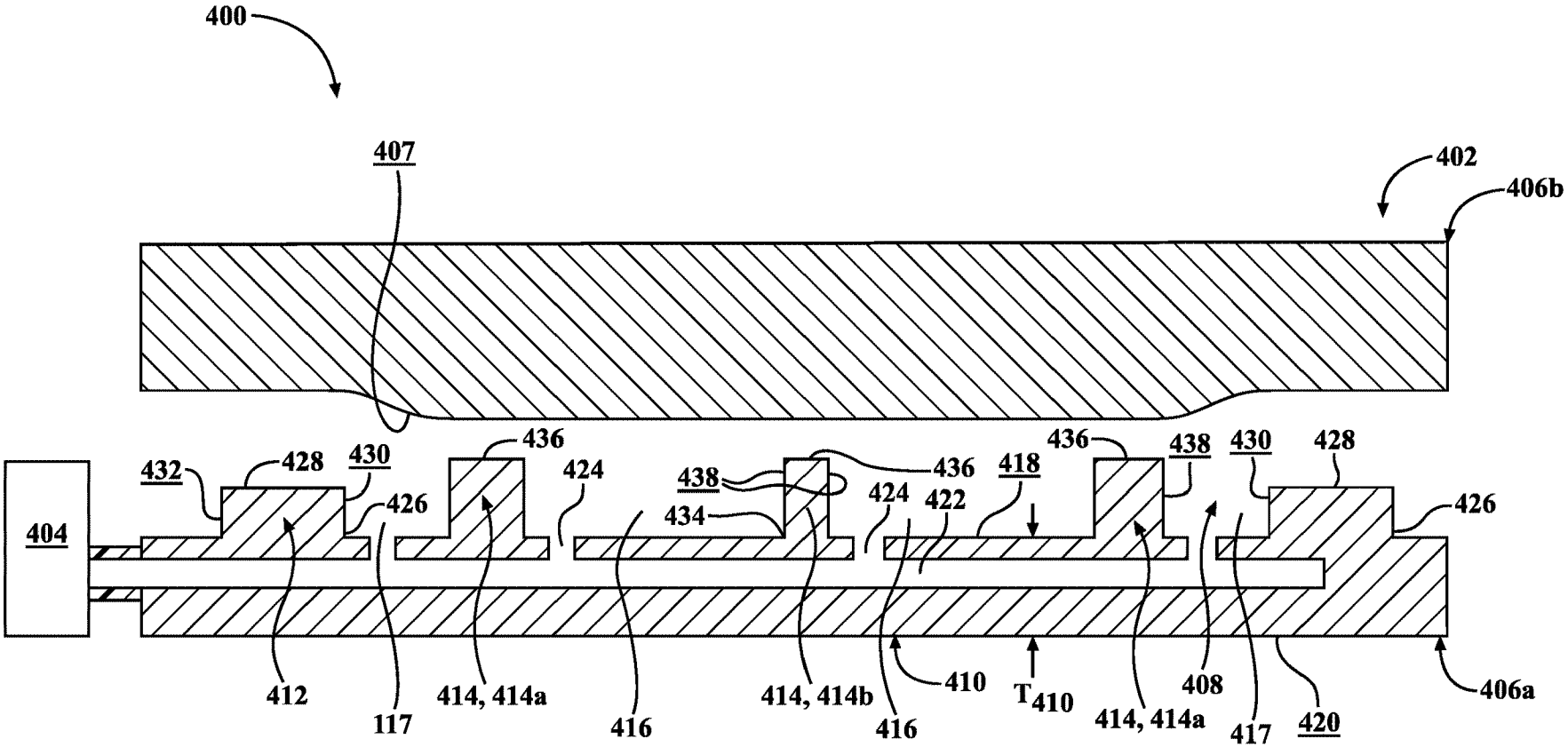
FIG. 10A is a cross-sectional view of a system for forming an upper according to the principles of the present disclosure.

With reference to FIG. 10A, the lower platen 406*a* includes a base 410, a chamber wall 412 extending from the base 410, and a cavity wall 414 extending from the base 410. As described in greater detail below, the chamber wall 412 provides a fixturing surface for components 500, 502 of a carcass layer 120*b*, while the base 410, the chamber wall 412, and the cavity wall 414 cooperate to define the mold chamber 408 having a plurality of mold cavities 416, 417.

As shown in FIG. 10A, the base 410 of the lower platen 406*a* includes an inner surface 418 and an outer surface 420 formed on an opposite side of the base 410 from the inner surface 418. As shown, the base 410 includes a manifold 422 extending along a length of the base 410 between the inner surface 418 and the outer surface 420. The manifold 422 is in communication with the vacuum source 404. As discussed in greater detail below, the base 410 of the first platen 406*a* includes a plurality of ports 424 extending from the manifold 422 and through the inner surface 418 of the base 410, thereby fluidly connecting the manifold 422 to each of the mold cavities 416, 417. Accordingly, each of the mold cavities 416, 417 is in fluid communication with the vacuum source 404 via the manifold 422.

With continued reference to FIG. 10A, the chamber wall 412 of the first platen 406*a* extends from a first end 426 at the inner surface 418 of the base 410 to a distal end 428 at the opposite end of the chamber wall 412 from the first end 426. The chamber wall 412 further includes an inner peripheral surface 430 and an outer peripheral surface 432 formed on an opposite side of the chamber wall 412 from the inner peripheral surface 430. The chamber wall 412 defines an outer perimeter of the mold chamber 408, whereby the chamber wall 412 is continuous and completely surrounds the mold chamber 408. As explained below, the distal end 428 of the chamber wall 412 is configured to interface with components 500, 502 for forming the carcass layer 120*b* during assembly of the carcass layer 120*b*. In some examples, the distal end 428 is substantially planar, whereby the height of the chamber wall 412 is constant. In other examples, a profile of the distal end 428 may be contoured. For example, the distal end 428 may be concave across the width to form a channel extending along a length of the chamber wall 412.

With continued reference to FIG. 10A, the cavity wall 414 of the first platen 406*a* extends from a first end 434 at the inner surface 418 of the base 410 to a distal end 436 at the opposite end of the cavity wall 414 from the first end 434. A distance from the inner surface 418 of the base 410 to the distal end 436 of the cavity wall 414 defines a height $H_{414}$ of the cavity wall 414. As shown, the height $H_{414}$ of the cavity wall 414 is greater than the height $H_{412}$ of the chamber wall 412. The cavity wall 414 further includes an opposing pair of side surfaces 438 extending from the inner surface 418 of the base 410 to the distal end 436. A distance between the side surfaces 438 defines a width $W_{414}$ of the cavity wall 414.

In the illustrated example, the cavity wall 414 includes a peripheral portion 414*a* and one or more interior portions 414*b*. The peripheral portion 414*a* of the cavity wall 414 is spaced inwardly from the chamber wall 412 to define a transitional cavity 417 between the chamber wall 412 and the cavity wall 414. The distal end 436 of the peripheral portion 414*a* is continuously formed and is configured to form the peripheral seam 304 around the perimeter of the formed carcass layer 120*b*, as described in greater detail below. Accordingly, a path along which a length of the peripheral portion 414*a* extends corresponds to a desired peripheral shape of the carcass layer 120*b*.

The interior portions 414*b* of the cavity wall 414 extend inwardly (i.e., in an opposite direction from the chamber wall 412) from the peripheral portion 414*a* of the cavity wall 414, and cooperate with the peripheral portion 414*a* to define the profiles of individual ones of the mold cavities 416. As discussed below, the interior portions 414*b* of the cavity wall 414 correspond to the desired locations of interior bonds forming the web area 126 of the carcass layer 120*b*. Accordingly, the arrangement (i.e., size, shape, location) of the interior portions 414*b* is selected based on desired shapes of the resilient pads 124 of the carcass layer 120*b*.

In some examples, the distal end 436 of the interior portions 414*b* of the cavity wall 414 extend continuously between the peripheral portion 414*a* of the cavity wall 414, whereby the resulting web area 126 also extends continuously around the resilient pads 124. Thus, adjacent ones of the resilient pads 124 defined by the respective interior portions 414*b* of the cavity wall 414 may be fluidly isolated from each other after the carcass layer 120*b* is formed. In some examples, the interior portions 414*b* of the cavity wall 414 may be discontinuous, or include one or more notches formed in the distal end 436 that extend continuously across the entire width of the interior portion 414*b*. These notches allow fluid communication between adjacent mold cavities 416 when the platens 406*a*, 406*b* of the mold 402 are in a closed position, and result in the formation of conduits that extend through the web area 126 and fluidly connect adjacent ones of the resilient pads 124 to each other.

The cavity walls 414 of each platen 406*a*, 406*b* are operable to bond the liners 136, 138 of the carcass layer 120*b* together at discrete locations to define the resilient pads 124. Particularly, the distal ends 436 of the cavity walls 414 provide energy E to the liners 136, 138 (i.e., barrier layers) to bond the liners 136, 138 to each other when the liners 136, 138 are compressed between opposing distal ends 436 of respective platens 406*a*, 406*b*. In the illustrated example, the distal ends 436 of the cavity walls 414 are configured for radio frequency (RF) welding such that when the liners 136, 138 are compressed between the distal ends 436 of cavity wall 414, high-frequency radio waves are supplied to the liners 136, 138 and the liners 136, 138 are welded together between the distal ends 436 to form the web area 126. In other examples, the cavity walls 414 may be configured for thermally bonding (i.e., melding) the liners 136, 138 together with each other. For example, the cavity walls 414 may have one or more elements for heating the distal ends 436 above a desired temperature for melding material(s) of the liners 136, 138 together.

With reference to FIGS. 10B-10G, the method of using the system 400 to form the carcass layer 120*b* is shown. The system 400 is provided with a first sheet 500 of material and a second sheet 500 of material corresponding to the liners 136, 138 of the formed carcass layer 120*b*. Each sheet 500 includes an inner surface 504 and an outer surface 506 disposed on an opposite side of the sheet 500 from the inner surface 504. A distance between the inner surface 504 and the outer surface 506 defines a thickness of the sheet 500. As discussed above, the material of the sheets 500 includes one or more thermoplastic polymers and/or one or more cross-linkable polymers.

As described in greater detail below, a gasket 502 is configured to be disposed between a distal end 428 of the chamber wall 412 of the first platen 406*a* and the mold surface 407 of the second platen 406*b* when the mold 402 is moved to a closed position. Accordingly, a length of the gasket 502 extends along a path corresponding to a length of the distal end 428 of the chamber wall 412. The gasket 502 includes a pair of sealing surfaces 508 formed on opposite sides of the gasket 502, whereby a distance from one sealing surface 508 to the other sealing surface 508 defines a thickness $T_{502}$ of the gasket 502. The gasket 502 further includes an inner peripheral surface 510 and an outer peripheral surface 512, each extending between the sealing surfaces 508 on opposite sides of the gasket 502. One or more conduits 514 are formed through the gasket 502 from the inner peripheral surface 510 to the outer peripheral surface 512.

Figure 10B:
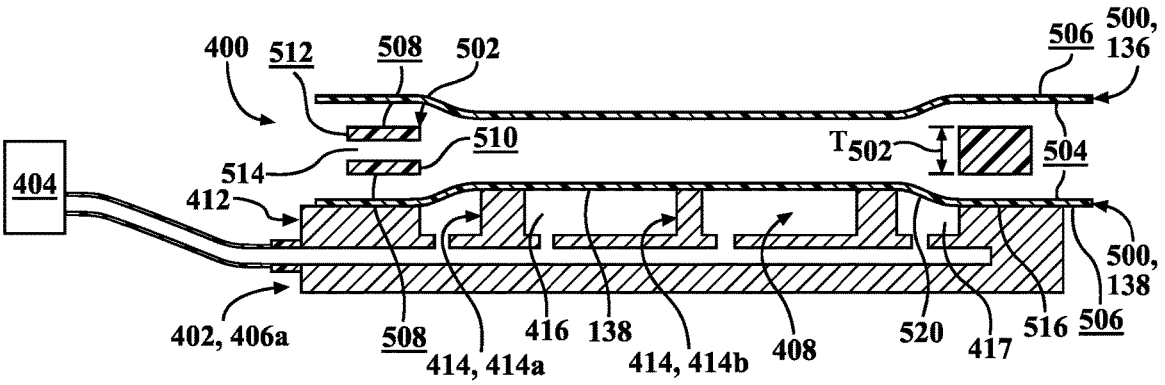
FIGS. 10B-10H are cross-sectional views of the system of FIG. 10A, showing steps of a method of using the system to form an upper according to the principles of the present disclosure.

In an initial step, shown in FIG. 10B, the mold 402 is provided in a fully opened position. Here, a first platen 406*a* is provided as a lower platen 406*a* so that the components 500, 502 for forming the carcass layer 120*b* can be provided to the mold 402. As shown, a first one of the sheets 500 of material is laid atop the chamber wall 412 and covers the mold chamber 408. The lower sheet 500 may be described as having a peripheral region 516 disposed on and supported by the chamber wall 412, and an inner region 518 surrounded by the peripheral region 516 and supported by the cavity wall 414. Because the height of the cavity wall 414 is greater than the height of the chamber wall 412, the inner region 518 may be vertically offset from the peripheral region 516. Accordingly, the lower sheet 500 may also have a transition region 520 extending between the peripheral region 516 and the inner region 518.

Figure 10C:
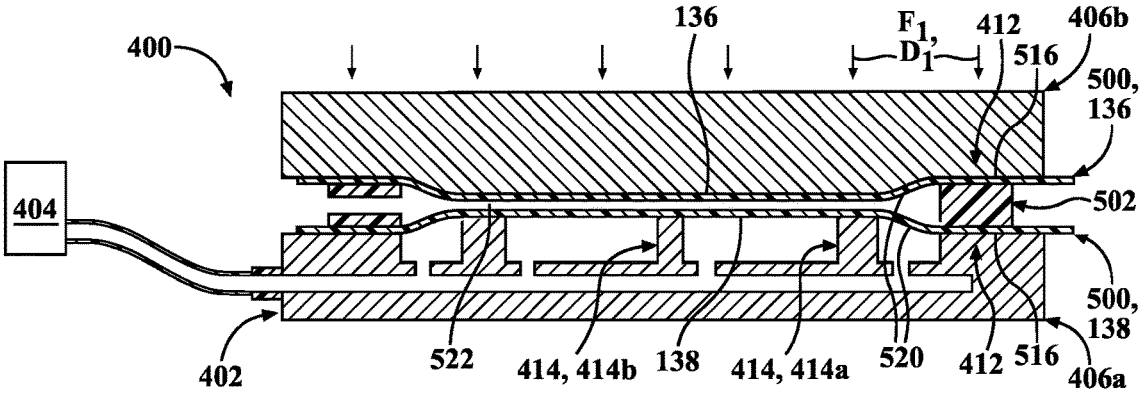

As shown in FIGS. 10B and 10C, the transition region 520 of the lower sheet 500 may span the transitional cavity 417 that separates the chamber wall 412 from the peripheral portion 414*a* of the cavity wall 414. As explained in greater detail below, the transitional cavity 417 of the first platen 406*a* is configured to accommodate flexure and expansion of the sheets 500 during manufacturing of the carcass layer 120*b*, but is not associated with forming a resilient pad 124 of the completed carcass layer 120*b*.

With the first one of the sheets 500 in place atop the lower platen 406*a*, the gasket 502 is disposed on the sheet 500 so that a bottom one of the sealing surfaces 508 is in contact with the inner surface 504 of the first sheet 500 along the peripheral region 516. Thus, the gasket 502 is also supported on the distal end 428 of the chamber wall 412 and surrounds the inner region 518 and the transition region 520 of the first sheet 500. When the gasket 502 is in a natural, uncompressed state, the gasket 502 will have a first thickness $T_{502}$ and the conduit 514 formed through the gasket 502 will be unrestricted.

With the gasket 502 in place, a second, upper sheet 500 is placed in the mold 402. As shown in FIG. 10C, the inner surface 504 of the upper sheet 500 contacts the upper sealing surface 508 of the gasket 502 in the peripheral region 516 of the upper sheet 500, while the inner surface 504 of the upper sheet 500 faces the inner surface 504 of the lower sheet 500 in the inner region 518.

Referring now to FIG. 10C, once all of the components 500, 502 are positioned within the mold 402, the mold 402 is moved to a first position by moving the platens 406*a*, 406*b* towards each other, as indicated by the arrows $D_1$. In the first position, a preload force $F_1$ is applied to the components 500, 502 by the mold plates 406*a*, 406*b* such that the peripheral region 516 of the lower sheet 500, the gasket 502, and the peripheral region 516 of the upper sheet 500 are compressed between the distal end 428 of the chamber wall 412 and the mold surface 407 of the respective platens 406*a*, 406*b*, thereby sealing the sheets 500 and the gasket 502 between the platens 406*a*, 406*b*. Here, the preload force $F_1$ is sufficient to form a seal between the sealing surfaces 508 of the gasket and the respective inner surfaces 504 of the sheets 500, while maintaining the conduit 514 of the gasket 502 in a substantially decompressed state.

Referring still to FIG. 10C, in the first position, the inner regions 518 of the sheets 500 will not be compressed by the distal ends 436 of the cavity wall 414. Accordingly, the inner surfaces 504 of the sheets 500 can be separated from each other to form a space 522 between the inner regions 518 of the sheets 500. Particularly, the sheets 500 are separated from each other by the space 522 between the distal end 436 of the cavity wall 414 and the mold surface 407 to allow for fluid to pass freely through the space 522 from one cavity 416 to another during the vacuum forming step of FIG. 10D.

Figure 10D:
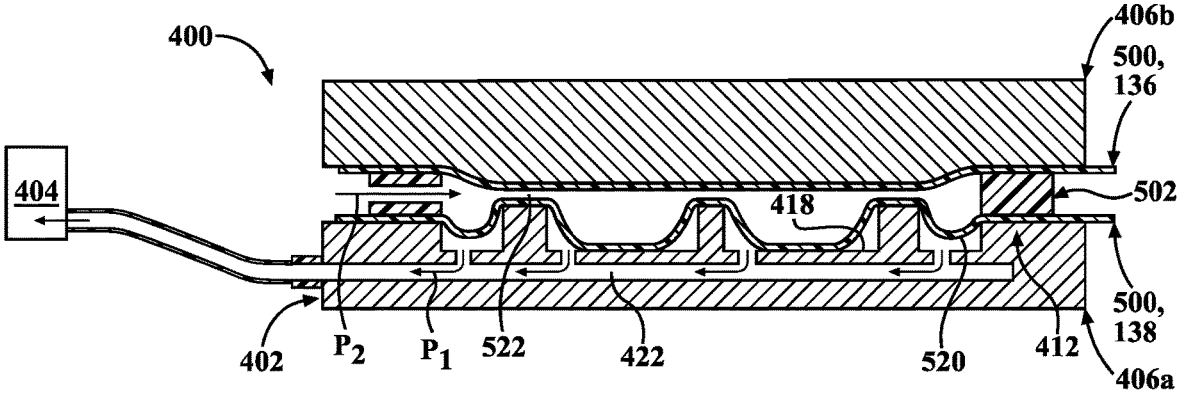

Turning now to FIG. 10D, when the mold is in the first position and the peripheral regions 516 of the sheets 500 are sealed against the gasket 502, the vacuum source 404 is activated to provide a negative first pressure $P_1$ within the manifolds 422 of each of the platens 406. The first pressure $P_1$ may be any pressure that is less than a second pressure $P_2$ within the space 522 between the sheets 500. In the illustrated example, the second pressure $P_2$ within the space 522 is atmospheric or ambient pressure and the first pressure $P_1$ is a negative pressure relative to atmospheric pressure. However, in some examples, the space 522 may be pressurized with a positive pressure (i.e., greater than atmospheric). The first pressure $P_1$ is communicated to each of the cavities 416, 417 of the mold 402 through respective ones of the ports 424. Consequently, the pressure differential between the first pressure $P_1$ within the cavities 416 and the second pressure $P_2$ within the space 522 causes the sheets 500 to be drawn towards surfaces 418, 430, 438 defining each of the cavities 416, 417.

Here, the magnitude of the first pressure $P_1$ determines the amount that the bottom sheet 500 is drawn into the cavity 416 of the lower platen 406*a* and, ultimately, the shape and pressure of the chambers 124 of the carcass layer 120. As discussed above, the sheets 500 that form the liners 136, 138 of the carcass layer 120 include an elastomeric material. Accordingly, when the first pressure $P_1$ is provided within the cavity 416 of the first platen 406*a*, the sheet 500 corresponding to the exterior liner 138 is drawn into the cavities 416 by an amount corresponding to the magnitude of the first pressure $P_1$. For example, a first pressure $P_1$ having a greater magnitude will draw the sheets 500 farther into the mold cavities 416 by stretching the sheets 500 to a greater degree. In the example of FIG. 10D, the magnitude of the first pressure $P_1$ is sufficient to draw the outer surfaces 506 of the sheets 500 against the surfaces 418, 438 defining the mold cavities 416. However, in other examples, the magnitude of the first pressure $P_1$ may be different, such that the sheets 500 are not stretched against the surfaces 418, 438 of the mold 402.

As the sheets 500 are drawn into the cavities 416 by the first pressure $P_1$, fluid, such as air and/or nitrogen, flows into the space 522 between the sheets 500 through the conduit 514 formed through the gasket 502. Accordingly, a volume of the space 522 is able to increase without causing the second pressure $P_2$ within the space 522 to decrease, thereby allowing the chambers 124 of the carcass layer 120 to be formed within the cavity 416. In the illustrated example, the conduit 514 is in communication with atmospheric pressure, whereby the second pressure $P_2$ will remain substantially equal to atmospheric pressure as the chambers 124 are formed. However, in other examples, the conduit 514 may be in communication with a positive pressure source, such as a pump (not shown), whereby the pressure within the space 522 is greater than atmospheric pressure.

With continued reference to FIG. 10D, the first pressure $P_1$ may also be applied to the transitional cavity 417, thereby drawing the transition region 520 of the sheet 500 corresponding to the exterior liner 138 into the transitional cavities 417. In some examples, the transitional cavities 417 may not be in communication with the vacuum source 404, and may simply provide spaces for flexure of the transition regions 520 of the sheets 500 when the mold 402 is moved between positions. Although the transitional regions 520 of the sheets 500 are not formed into resilient pads 124 of the carcass layer 120, allowing the transition regions 520 to flex and move within the transitional cavity 417 may accommodate expansion and shifting of the sheets 500 during the vacuum forming step.

Figure 10E:
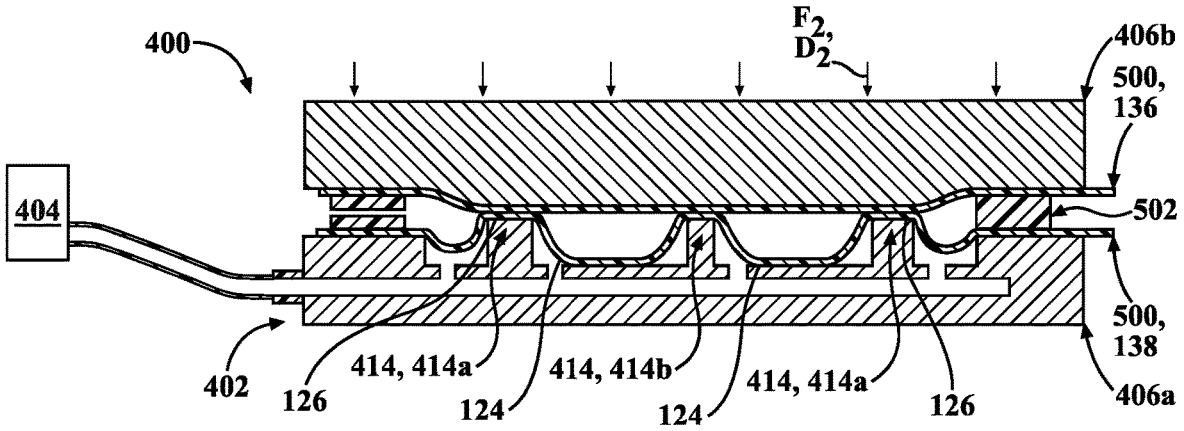

Referring to FIG. 10E, once the inner region 518 of the sheet 500 corresponding to the exterior liner 138 is drawn into the cavity 416, thereby forming the shapes of the resilient pads 124 of the carcass layer 120, the mold 402 is moved to a second position to seal the inner surfaces 504 of the sheets 500 together, as indicated by the directional arrows $D_2$. In the second position, a sealing force $F_2$ is applied to the components 500, 502 of the mold such that the inner regions 518 of the sheets 500 are compressed together by the opposing distal ends 428 of the cavity walls 414 to seal the interior void of each chamber 124. The sealing force $F_2$ is greater than the preload force $F_1$. For example, the sealing force $F_2$ may be approximately 1000 pounds-force (4448 Newtons) while the preload force is approximately 50 pounds-force (222 Newtons). Under the sealing force $F_2$, the peripheral portions 414*a* of the cavity walls 414 seal a portion of the inner region 518 corresponding to the peripheral web area 126 of the carcass layer 120, while the interior portion 414*b* of the cavity wall 414 seals portions of the inner region 518 corresponding to the inner web area 126 of the carcass layer 120.

Figure 10F:
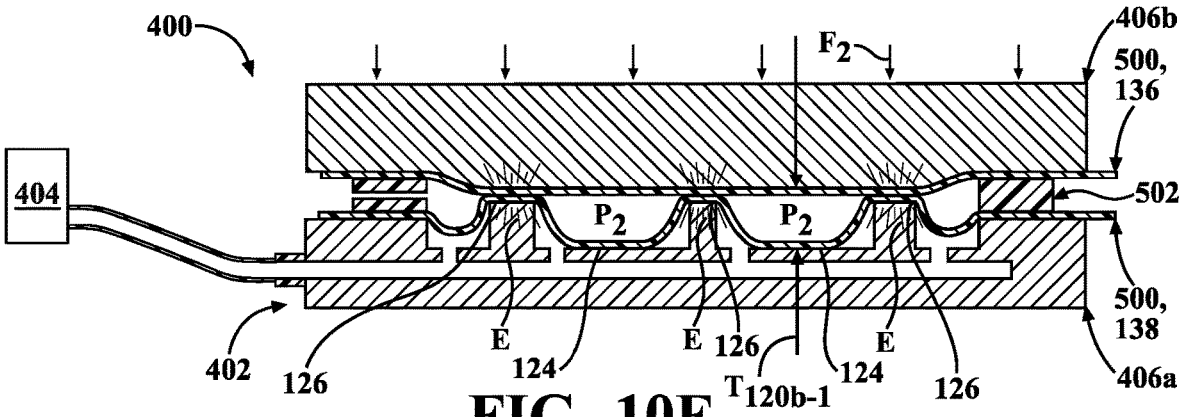

As shown in FIG. 10F, with the resilient pads 124 formed and the inner regions 518 of the sheets 500 sealed between the cavity walls 414 and the mold surface 407, energy E is provided to the distal ends 428 of the cavity wall 414 and/or the mold surface 407 to bond the compressed regions of the sheets 500 together, thereby forming the web area 126 of the carcass layer 120. As discussed above, the energy E provided to the distal ends 428 of the cavity wall 414 and/or the mold surface 407 may be high frequency electromagnetic energy for radio-frequency (RF) welding the sheets 500 together. In other examples, the energy E may be a thermal energy, whereby the sheets 500 are melded together at the web area 126.

Figure 10G:
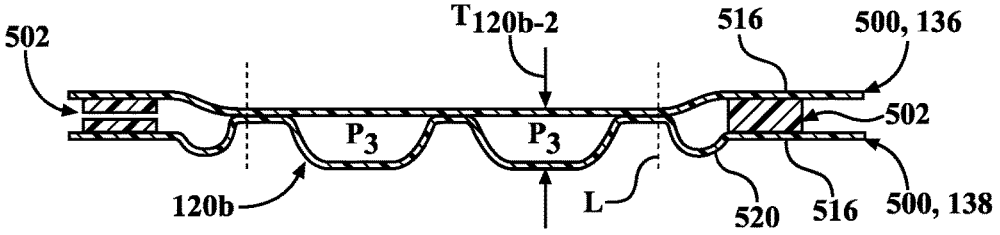

At FIG. 10G, the molded components 500, 502, which include the formed carcass layer 120, are removed from the mold 402 for post-processing. As discussed above, during the mold process a first pressure $P_1$ is applied to the outer surfaces 506 of the elastomeric sheets 500 to draw the sheets 500 into the mold cavities 416. The first pressure $P_1$ is maintained on the sheets 500 while the sheets 500 are formed into liners 136, 138 of the carcass layer 120, such that the second pressure $P_2$ within the space 522 between the sheets 500 is sealed within the interior voids 144 of the resilient pads 124 while the sheets 500 are in a stretched state (i.e., the bladder has a first thickness $T_{120b\text{-}1}$ in the mold). Upon removal of the molded carcass layer 120 from the mold 402, the first pressure $P_1$ is released and the elasticity of the material forming the sheets 500 may cause the sheets (now liners 136, 138) to contract (i.e., the carcass layer 120 has a second thickness $T_{120b\text{-}2}$ when removed from the mold).

Upon contraction, the fluid within the interior voids of the resilient pads 124 is compressed by the sheets 500, such that the pressure of the fluid may increase from the second pressure $P_2$ to a third pressure $P_3$. The magnitude of the pressure increase in the resilient pad 124 is directly related to the strain imparted on the sheet 500 corresponding to the exterior liner 138 by the first pressure $P_1$, as well as the modulus of elasticity of the material forming the sheets 500. For example, where the sheets 500 are formed of an inelastic material, the pressure increase may be negligible as the sheets 500 remain in the stretched state upon release of the negative pressure. However, for materials having a relatively low modulus of elasticity, applying a greater first pressure $P_1$ to the sheets 500 causes increased strain in the elastomeric material during the molding process, which results in a greater pressure increase within the interior void when the first pressure $P_1$ is released and the material contracts.

Figure 10H:
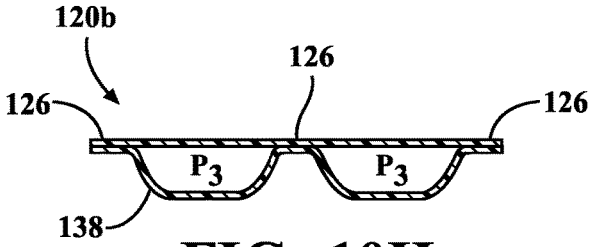

With continued reference to FIGS. 10G and 10H, the carcass layer 120 is finished by trimming the sheets 500 at the cut line L along the peripheral seam 304 to separate the peripheral regions 516 of the sheets 500 and the gasket 502 from the formed carcass layer 120. Because the gasket 502 and the peripheral regions 516 of the sheets 500 are not bonded to each other during the molding process, the gasket 502 can be separated from the trimmed peripheral portions 516 of the sheets 500 for reuse in subsequent molding operations.

The following Clauses provide an exemplary configuration for an upper for an article of footwear and an article of footwear described above.

Clause 1: An upper for an article of footwear, the upper including a carcass layer including an interior liner defining an interior void of the upper and an exterior liner joined to the interior liner to define a plurality of resilient pads protruding from an exterior surface of the upper.

Clause 2: The upper of Clause 1, further comprising an outer shell attached to the exterior liner of the carcass layer and including a plurality of openings each configured to receive a respective one of the resilient pads therethrough.

Clause 3: The upper of Clause 2, wherein each of the resilient pads includes a distal end surface defining a first portion of a ball control surface and the outer shell defines a second portion of the ball control surface.

Clause 4: The upper of any one of Clauses 1-3, wherein each of the resilient pads includes a compressible material enclosed between the interior liner and the exterior liner.

Clause 5: The upper of Clause 4, wherein the compressible material includes a compressible fluid.

Clause 6: The upper of any one of Clauses 1-5, wherein each of the resilient pads includes a tensile element disposed therein.

Clause 7: The upper of any one of Clauses 1-6, wherein the plurality of resilient pads includes one or more resilient pads in a toe portion of the upper, one or more resilient pads in a ball portion of the upper, and one or more resilient pads in a mid-foot region of the upper.

Clause 8: The upper of any one of Clauses 1-7, wherein the plurality of resilient pads includes at least one lateral pad disposed on a lateral side of the upper, at least one medial pad disposed on a medial side of the upper, and at least one throat pad disposed on a throat portion of the upper.

Clause 9: The upper of any one of Clauses 1-8, wherein each of the interior liner and the exterior liner includes a polymeric film material.

Clause 10: The upper of any one of Clauses 1-9, wherein the interior liner includes a first material and the exterior liner includes a second material that is different than the first material.

Clause 11: An upper for an article of footwear, the upper including a carcass layer including an interior liner defining an interior surface of the upper and an exterior liner defining an exterior surface of the upper, the exterior liner joined to the interior liner along a web area to form a plurality of resilient pads on the exterior surface of the upper.

Clause 12: The upper of Clause 11, further comprising an outer shell attached to the exterior liner of the carcass layer and including a plurality of openings each configured to receive a respective one of the resilient pads therethrough.

Clause 13: The upper of Clause 12, wherein each of the resilient pads includes a distal end surface defining a first portion of a ball control surface and the outer shell defines a second portion of the ball control surface.

Clause 14: The upper of any one of Clauses 11-13, wherein each of the resilient pads includes a compressible material enclosed between the interior liner and the exterior liner.

Clause 15: The upper of Clause 14, wherein the compressible material includes a compressible fluid.

Clause 16: The upper of any one of Clauses 11-15, wherein each of the resilient pads includes a tensile element disposed therein.

Clause 17: The upper of any one of Clauses 11-16, wherein the plurality of resilient pads includes one or more resilient pads in a toe portion of the upper, one or more resilient pads in a ball portion of the upper, and one or more resilient pads in a mid-foot region of the upper.

Clause 18: The upper of any one of Clauses 11-17, wherein the plurality of resilient pads includes at least one lateral pad disposed on a lateral side of the upper, at least one medial pad disposed on a medial side of the upper, and at least one toe pad disposed on a toe portion of the upper.

Clause 19: The upper of any one of Clauses 11-18, wherein each of the interior liner and the exterior liner includes a polymeric film material.

Clause 20: The upper of any one of Clauses 11-19, wherein the interior liner includes a first material and the exterior liner includes a second material that is different than the first material.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

The invention claimed is:

1. An upper for an article of footwear, the upper comprising:

a carcass layer including a substantially flat interior liner defining an interior void of the upper, an exterior liner joined to the interior liner and a plurality of resilient pads protruding from an exterior surface of the upper, each resilient pad of the plurality of resilient pads being completely enclosed by the interior liner and the exterior liner;

wherein the plurality of resilient pads includes one or more resilient pads in a toe portion of the upper, one or more resilient pads in a ball portion of the upper, and one or more resilient pads in a mid-foot region of the upper, wherein the one or more resilient pads in the toe portion of the upper are disposed completely within the toe portion, and wherein each resilient pad of the plurality of resilient pads is disposed between the exterior liner and the interior liner.

2. The upper of claim 1:

wherein each resilient pad of the plurality of resilient pads includes a distal end surface on the exterior liner defining a portion of a ball control surface; and wherein the distal end surface spans an area extending substantially parallel to the substantially flat interior liner.

3. The upper of claim 1, wherein the toe portion of the upper, the ball portion of the upper, and the mid-foot region of the upper are disposed on a lateral side of the upper or are disposed on a medial side of the upper.

4. The upper of claim 1, wherein the plurality of resilient pads includes at least one throat pad disposed on a throat portion of the upper.

5. The upper of claim 1, wherein each resilient pad of the plurality of resilient pads includes an interior void enclosed between the interior liner and the exterior liner.

6. The upper of claim 1, wherein each resilient pad of the plurality of resilient pads includes a tensile element disposed therein.

7. The upper of claim 1, wherein each resilient pad of the plurality of resilient pads includes a cushioning element disposed therein.

8. An article of footwear incorporating the upper of claim 1.

9. The upper of claim 1, wherein each resilient pad of the plurality of resilient pads includes an interior void and a cushioning element disposed within the interior void of the resilient pad.

10. The upper of claim 1, wherein each resilient pad of the plurality of resilient pads includes an interior void filled with a compressible fluid.

11. An upper for an article of footwear, the upper comprising:

a carcass layer including a substantially flat interior liner defining an interior surface of the upper and an exterior liner defining an exterior surface of the upper, the exterior liner joined to the interior liner along a web area to form a plurality of resilient pads on the exterior surface of the upper, the plurality of resilient pads being completely enclosed within the carcass layer, wherein the plurality of resilient pads includes one or more resilient pads in a toe portion of the upper, one or more resilient pads in a ball portion of the upper, and one or more resilient pads in a mid-foot region of the upper, wherein at least one pad of the one or more resilient pads in the toe portion are disposed completely within the toe portion, and wherein each resilient pad of the plurality of resilient pads includes a distal end surface on the exterior liner spanning an area extending substantially parallel to the substantially flat interior liner.

12. The upper of claim 11:

wherein the plurality of resilient pads further includes one or more resilient pads in a second toe portion of the upper, one or more resilient pads in a second ball portion of the upper, and one or more resilient pads in a second mid-foot region of the upper are arranged to form of resilient pads; and wherein the toe portion of the upper, the ball portion of the upper, and the mid-foot region of the upper are disposed on a medial side of the upper; and wherein the second toe portion of the upper, the second ball portion of the upper, and the second mid-foot region of the upper are disposed on a lateral side of the upper.

13. The upper of claim 11, wherein the plurality of resilient pads are arranged to form a first row of resilient pads extending continuously along a periphery of the upper.

14. The upper of claim 13, wherein the ball portion of the upper is disposed on a lateral side of the upper and the mid-foot region of the upper is disposed on a medial side of the upper, the first row of the plurality of resilient pads extending from the ball portion of the upper, around an anterior end of the upper, to the mid-foot region of the medial side of the upper.

15. The upper of claim 14, wherein the plurality of resilient pads are arranged to form a second row of resilient pads extending continuously along a periphery of the upper, the second row being disposed above the first row and being vertically spaced from the first row by the web area.

16. The upper of claim 15, wherein the first row of resilient pads is vertically aligned with the second row of resilient pads.

17. The upper of claim 16, wherein each resilient pad of the plurality of resilient pads includes an elongate shape and extend along a periphery of the upper.

18. An article of footwear incorporating the upper of claim 11.

19. The upper of claim 11, wherein the distal end surfaces of the plurality of resilient pads collectively define a primary ball control surface and wherein the web area defines a secondary ball control surface.

20. The upper of claim 19, wherein each resilient pad of the plurality of resilient pads is configured to be compressed by a ball to allow the ball to engage the secondary ball control surface after initially contacting the primary ball control surface.

* * * * *